US005459505A

United States Patent [19]

Ballegaard et al.

[11] Patent Number: 5,459,505

[45] Date of Patent: Oct. 17, 1995

[54] LASER IMAGE SETTER

[75] Inventors: Hans P. Ballegaard, Lystrup; Mikael F. Bering, Aarhus; Agner Hansen, Rønde, all of Denmark

[73] Assignee: Purup Prepress A/S, Lystrup, Denmark

[21] Appl. No.: 104,087

[22] PCT Filed: Feb. 21, 1992

[86] PCT No.: PCT/DK92/00052

§ 371 Date: Oct. 4, 1993

§ 102(e) Date: Oct. 4, 1993

[87] PCT Pub. No.: WO92/14609

PCT Pub. Date: Sep. 3, 1992

[30] Foreign Application Priority Data

Feb. 22, 1991 [DK] Denmark ..... 317/91

[51] Int. Cl.[6] ..... B41J 2/435

[52] U.S. Cl. ..... 342/260

[58] Field of Search ..... 347/256, 260, 347/134; 358/296, 298, 300, 302

[56] References Cited

U.S. PATENT DOCUMENTS

| | | | |
|---|---|---|---|
| 3,958,250 | 5/1976 | Rolon . | |
| 4,122,496 | 10/1978 | Childress et al. . | |
| 4,342,504 | 8/1982 | Ebner . | |
| 4,564,866 | 1/1986 | Comberg | 358/296 |
| 4,595,957 | 6/1986 | Holthusen . | |
| 4,853,709 | 1/1989 | Stein et al. . | |
| 5,109,459 | 4/1992 | Eibert et al. | 385/115 |

FOREIGN PATENT DOCUMENTS

| | | |
|---|---|---|
| 0126469 | 11/1984 | European Pat. Off. . |
| 0217136 | 4/1987 | European Pat. Off. . |
| 0264341 | 4/1988 | European Pat. Off. . |

OTHER PUBLICATIONS

Journal Of Imaging Technology; vol. 11, No. 6, Dec. 1985, Springfield, Virginia, U.S.; pp. 300–305; G. K. Starkweather: "A High Resolution Laser Printer".

*Primary Examiner*—Mark J. Reinhart

*Attorney, Agent, or Firm*—Merchant & Gould, Smith, Edell, Welter & Schmidt

[57] ABSTRACT

An apparatus is described for exposing a film or plate comprising a light-sensitive material to a light beam. The apparatus comprises an apparatus housing having an elongated cavity or drum defining a substantially circularly-cylindrical inner support (100) for supporting the film or plate and defining a central axis, laser means (122, 124, 126) for generating the light beam, a light-directing assembly (102) comprising a laser light-emitter, a rotatable optically reflecting element (170) and an element-rotating motor (178) having a rotatable output shaft connected to the optically reflecting element (170). The laser light-emitter is constituted by the second end of an optical fiber means (122, 124, 126) having a first-light receiving end being arranged in juxtaposition to the laser means for receiving the light beam therefrom. The second light-emitting end is in juxtaposition to the rotatable optically reflecting element (170) at a substantially fixed distance therefrom for emitting the light beam to the rotatable optically reflecting element (170). The rotatable optically reflecting element is arranged so as to direct the light beam to the light-sensitive film or plate, and the light-directing assembly (102) is movable relative thereto along the central axis. The apparatus further comprises motion means for moving the light-directing assembly (102) relative to the apparatus housing along the central axis, and central control means for controlling the laser means (122, 124, 126), the element-rotating motor (178), and the motion means so as to expose a predetermined area of the photographic film.

24 Claims, 8 Drawing Sheets

432
420
422
402
406
412
410
404
408
400
370
366
362
364
368
350
424
390
398
396
374
352
356
360
354
358
320
394
392
326
336
334
316
304
322
340
338
372
300
214
210
196
200
206
122
116
104
224
208
194
212
204
192
182
382
100
198
130
132
134
136
144
190
188
184
186
178
222
240
258
248
176
187
193
102
b
174
154
384
146
152
140
150
102a
386
220
242
244
246
270
250
268
278

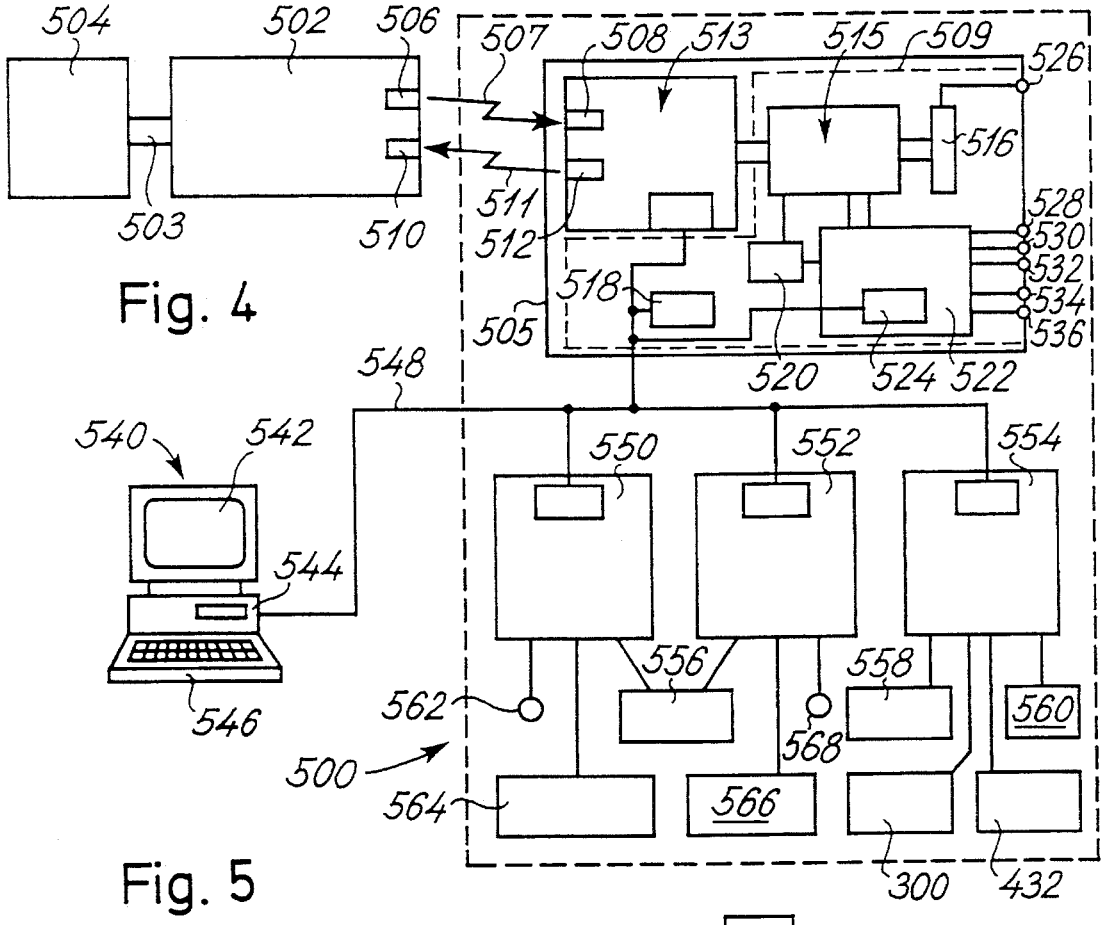
Fig. 4
Fig. 5
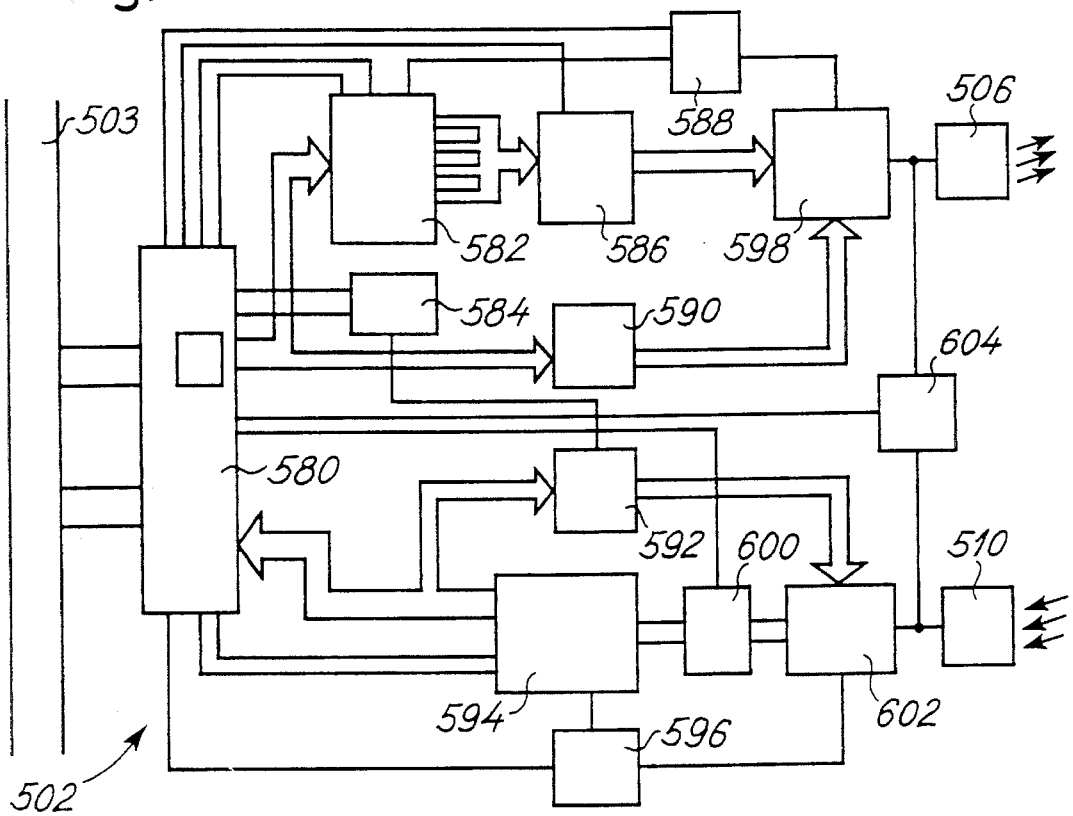

LASER IMAGE SETTER

BACKGROUND OF THE INVENTION

The present invention relates to an internal drum laser image setter, i.e. an apparatus for exposing a film or plate covered with a light-sensitive material, the film or plate being supported to that it constitutes part of a circular cylinder ("drum"), to a laser light beam directed substantially from the center of the cylinder to the film or plate.

Internal drum laser image setters (also called internal laser image drum plotters) are used for high accuracy production of images comprising graphics, maps, and text. Examples of known internal drum laser image setters or plotters are disclosed in U.S. Pat. Nos. 4,853,709, 4,595,957 and 3,958,250, and in EP Patent Application No. 0 127 136. An example of a known, so-called external drum laser image setter is disclosed in U.S. Pat. No. 4,122,496.

An increasingly important use of internal drum laser image setters is for production of films for producing high-quality offset printing masks or plates, or for direct production of offset plates, i.e. so-called "prepress" work.

One type of internal drum laser image setter which has become widely accepted in the graphic industry as an efficient and accurate apparatus comprises a range of laser image setters of the types 5100 and 7100 from the company Purup Electronics A/S, Lystrup, Denmark. In these apparatuses, an assembly, a so-called "spinner assembly" comprising a rotating prismatic, light-reflecting element from which the laser light beam is directed to light-sensitive material arranged in the interior of the drum, is moved along a central axis of the drum of the apparatus. The laser light beam received by the prismatic element is output from a laser arranged at one end of the drum. The rotatable light reflecting element is rotated by means of a motor which constitutes a component of the spinner assembly.

The apparatus of the present invention is based on a construction principle which results in an even higher absolute accuracy than that obtainable in the known apparatuses and which provides a number of important advances and advantages which will be apparent from the following. The increased absolute accuracy is of importance, e.g., in four-colour print work, where four films produced in the apparatus are to be aligned in the preparations for the printing process.

The apparatus of the invention for exposing a film or plate comprising a light-sensitive material to a light beam comprises an apparatus housing having an elongated cavity defining an inner support for supporting the film or plate in such a manner that the supported film or plate constitutes at least a part of a substantially circularly-cylindrical surface defining a central axis, laser means for generating the light beam, a light-directing assembly comprising a light-directing assembly housing, a laser light-emitter emitting laser light generated by the laser means, a rotatable optically reflecting element and an element-rotating motor, the laser light-emitter being constituted by the second end of an optical fibre means having a first light-receiving end and a second light-emitting end, the first light-receiving end being arranged in juxtaposition to the laser means for receiving the light beam therefrom, and the second light-emitting end being arranged in and supported by the light-directing assembly housing and being in juxtaposition to the rotatable optically reflecting element at a substantially fixed distance therefrom for emitting the light beam to the rotatable optically reflecting element, the rotatable optically reflecting element being arranged relative to the second light-emitting end of the optical fiber so as to direct the light beam emitted to the optically reflecting element to the light-sensitive film or plate, the element-rotating motor being supported by the light-directing assembly housing and having a rotatable output shaft, the optically reflecting element being connected to the output shaft so as to be rotatably driven thereby, and the light-directing assembly housing being supported by the apparatus housing and being movable relative thereto along the central axis, motion means for moving the light-directing assembly relative to the apparatus housing along the central axis, and central control means for controlling the laser means for switching the laser beam on and off, for controlling the operation of the element-rotating motor, and for controlling the operation of the motion means so as to expose a predetermined area of the photographic film by switching on the laser beam while the light-directing assembly is in a predetermined position relative to the apparatus housing and while the rotatable optically reflecting element is in a predetermined rotational position.

In the apparatus of the invention, the quality of the light beam, and thereby the quality and precision of the spot generation, may be considerably improved because of the use, according to the invention, of the optical fiber means. Thus, when transmitting the light beam through an optical fiber, irregularities in the laser light, especially ellipticity of the beam profile, will tend to be corrected during the passage through the fiber so as to result in a beam of light with a circular beam profile; in particular when the fibers are single-mode fibers with respect to the wavelength of the laser light, a circular Gaussian beam with known properties will be generated. Thus, in a preferred embodiment of the invention, the optical fiber means is a single-mode optical fiber with respect to the wavelength of the laser light, preferably a fiber with a glass core, and is of sufficient length to ensure substantial conversion of the light beam emitted from the laser into a circular Gaussian light beam with known properties.

A particularly advantageous feature of the apparatus of the invention is that even though the laser light emitter, which is positioned within the apparatus housing, is supported by the light-directing assembly housing and thus moves together with the optically reflecting element and is arranged in juxtaposition thereto at a substantially fixed distance therefrom, the actual source of the laser light, i.e. the laser of the laser means itself—which will normally generate very considerable heat which can adversely affect, for example, the light-sensitive material and/or the dimensional stability of components such as the light-directing assembly within the apparatus housing—may be located at a position relatively remote from heat-sensitive components within the apparatus housing, and will preferably be thermally insulated therefrom. In preferred embodiments of the apparatus, the laser means is arranged outside the apparatus housing proper. However, the laser means may also be arranged in and supported by the light-directing assembly housing, and thus, travel therewith. In this case the fiber should preferably be coiled up and arranged at the light-directing assembly and the laser should preferably be a laser having a relatively low heat production, such as a diode laser.

In previously known apparatuses in which the laser light emitter is arranged at a fixed position and the optically reflecting element moves relative to the laser light emitter, this movement of the light-emitter relative to the reflecting element may give rise to minor inaccuracy due to a incompletely accurate and insufficiently frictionless motion of the spinner assembly along the central axis of the internal drum. That these initially minor inaccuracies may become important is apparent, e.g., from the fact that in a large internal drum laser image setter which is capable of exposing a photographic film measuring 25"×25", the distance from the light beam generating laser to the spinner assembly varies from a few inches to more than 25 inches.

An important advantage of the mechanical principle of the present invention is that improved accuracy is obtained making use of a construction which is simpler than that in the known apparatuses of lower accuracy. The attainment of adequate accuracy in a system comprising a fixed light-emitter (laser) on the one hand and a movable light-directing assembly on the other hand requires very precise adjustment of the whole apparatus, i.e. of the laser relative to the system comprising the apparatus housing and the moving light-directing assembly. In contrast, the constructional principles underlying the present invention make it possible to carry out fine adjustment of the apparatus housing per se, while the complete light-directing assembly comprising the laser light-emitter and the rotatable optically reflecting element can be adjusted as a small, separate element.

None of the patent documents mentioned above disclose or infer the possibility of using optical fibers to direct the laser light to desired locations within the apparatus, and neither do they disclose or infer any advantages associated therewith.

In preferred embodiments of an apparatus of the invention, the light beam generated by the laser means arranged outside or inside the apparatus housing is directed to the rotatable optically reflecting element of the light-directing assembly via the optical fiber means, thereby improving (vide supra) the quality of the beam and reducing the distance between the light-emitter and the rotatable optically reflecting element to a smaller, substantially fixed distance which is independent of the actual position of the light-directing assembly relative to the supporting apparatus housing.

Whereas previously known internal drum laser image setters appear to be limited to a single colour exposure from the single laser arranged at the end of the drum, the above-described construction using optical fibers makes it possible to use a laser means which comprises a plurality of lasers, the optical fiber means comprising a plurality of optical fibers or possibly fiber bundles, individual fibers or fiber bundles being connected to individual lasers. This makes it possible to adapt the apparatus of the invention to produce multicolour light exposure, such as exposure by light generated by means of a red, a green and a blue light source and together constituting a RGB (Red, Green and Blue) colour system. One important use of such an embodiment is the production of so-called proof prints, i.e. prints made on a photographic colour film which is exposed to multicolour light.

While temperature control is, of course, important with respect to the accuracy, control of the humidity is at least as important because of the pronounced tendency of most light-sensitive materials, such as photographic film, to undergo dimensional changes with changes in humidity. Thus, according to a very preferred embodiment of the invention, a domain of the apparatus comprising the apparatus housing and the light-directing assembly is encapsulated, preferably with a thermally insulating material, and the encapsulated domain is air-conditioned by means of a controllable air conditioning unit to permit control of temperature and humidity conditions within the domain.

The laser of the laser means of the apparatus of the invention may suitably be selected from argon ion lasers, HeNe lasers, HeCd lasers, frequency-doubled Nd:YAG lasers, and diode lasers, including frequency-doubled diode lasers.

The apparatus according to the present invention may comprise any appropriate rotatable optically reflecting element such as a rotating or rotatable mirror, a rotatable lens, a rotatable prism or the like or a combination thereof. In accordance with the presently preferred embodiment of the apparatus according to the present invention, the rotatable optically reflecting element is constituted by a rotatable optical prismatic element which is rigidly connected to the output shaft of the element motor and which is rotatable in a rotational motion defining a rotational axis which coincides with the central axis. In this preferred embodiment of the apparatus according to the present invention, the light beam emitted from the light-emitter is directed to the rotatable optical prismatic element along the central axis defined by the cylindrical supporting wall constituting the internal drum wall of the apparatus.

In the preferred embodiment of the apparatus the output shaft of the element-rotating motor is rotatably journaled in the light-directing assembly by means of air guidings, i.e. journals or bearings based on an air film, so as to reduce vibrations in the light-directing assembly.

Although the light-emitter, which in the presently preferred embodiment of the apparatus is constituted by the light-emitting second end of the optical fiber means, may be arranged so as to emit the light beam directly to the rotatable optically reflecting element, an iris means and a collimator means are preferably interposed between the light-emitter and the rotatable optical prismatic element and are supported by the light-directing assembly housing so as to render it possible to accurately control the transmission of the light beam from the light-emitting second end of the optical fiber means (constituting the light-emitter) to the rotatable optically reflecting element which reflects the light beam towards the photographic film supported by the inner support surface of the apparatus housing. Thus, the light beam may be accurately positioned, narrowed, spread and/or focused relative to the rotatable optically reflecting element.

Although the central control means of the apparatus may autonomously control the operation of the motion means and of the element-rotating motor of the light-directing assembly, the apparatus according to the present invention preferably further comprises an encoder means connected to the central control means and generating an encoder signal representing the rotational position of the rotatable optically reflecting element relative to the central axis. This encoder signal is suitably used by the central control means to control the motion means in accordance with the encoder signal. While a commercially available encoder means with an encoder disc mounted on a separate shaft connectable to the shaft on which the optically reflecting element is mounted would be useful in the apparatus of the invention, it has been found that an even higher degree of accuracy is obtained when the encoder disc is fixed directly to the same shaft as that to which the rotatable optically reflecting element is fixed, thereby eliminating small deviations deriving from the coupling of two shafts.

It is preferred that both the element-rotating motor and the motion means are operated under the continuous control of the central control means, the motion means preferably being operated in response to the encoder signal. The motion means may be a linear motor, a step motor, an electric AC or DC motor, a single- or multiphase motor or the like and/or hydraulically or pneumatically driven means and/or mechanical coupling means, such as shafts, gear boxes, toothed rods, toothed wheels, piezo worms, etc. or a combination thereof. In a presently preferred embodiment of the apparatus according to the present invention, the motion means comprises a threaded shaft, preferably a multi-threaded shaft, and a drive motor, such as a step motor, connected to the threaded shaft for causing the threaded shaft to rotate; in this case the apparatus also has a part, such as a threaded bore or a nut, meshing with the threaded shaft, preferably a recirculating planetary roller meshing with the threaded shaft. The drive motor may be supported by the apparatus housing or alternatively by the light-directing assembly housing, whichever is appropriate.

As the threaded shaft is caused to rotate by the drive motor, the meshing of the threaded bore or nut and the threaded shaft causes the light-directing assembly to move. As mentioned above, the drive motor is preferably a step motor, in particular a step motor which is adequately dimensioned to ensure that it will substantially always respond completely to the control by the central control means, thus rendering any sensing/feedback of the operation of the motion means superfluous.

The light-directing assembly housing may be journalled and supported by the apparatus housing in any appropriate manner by means of journalling means such as rollers, shafts, bearings or the like.

It is preferred, however, that the light-directing assembly housing is supported by the apparatus housing through a carriage which is supported by the apparatus housing through guiding means which permit the carriage to move parallel to the central axis.

In a preferred embodiment, the guiding means comprise two bearing elements extending longitudinally parallel to the central axis, one of the bearing elements supporting the carriage in a two-plane manner, the other bearing element supporting the carriage in a one-plane manner, the two bearing elements together thus supporting the carriage in a statically determined manner. (The term "statically determined manner" is used here in spite of the fact that the linear character of the bearing elements, as contrasted to three supporting points, does not permit a theoretically ideal static determination).

In a preferred embodiment, the carriage is pulled downwards towards the apparatus housing by magnetic attraction forces generated by magnets arranged longitudinally in the carriage or in the housing, so as to assist the gravity force in securing the carriage to the apparatus housing and to preload the carriage against the apparatus housing to secure permanent contact between the carriage and the apparatus housing through the bearing elements, maintaining the support of the carriage in a statically determined manner. This preferred embodiment ensures a high stability and precision and counteracts any tendency for the carriage to move in any direction transverse to the longitudinal direction parallel to the central axis.

The magnets are preferably arranged longitudinally in the carriage in such a manner that the concentration of magnetic forces is higher along a part of the carriage where the light-directing assembly is arranged so as to compensate for or counteract an added moment along that part.

The bearing means may be selected from ball or roller bearing assemblies, sliding guides, and aerostatic bearing assemblies. The bearing means are preferably ball bearing assemblies for providing a low friction and low vibration journalling of the entire light-directing assembly, and thus for providing a vibrationless and extremely accurate linear motion of the light-directing assembly and consequently of the rotatable optically reflecting element along the central axis of the apparatus housing.

The apparatus housing is preferably made from a material which provides high dimensional stability. One preferred material is cast iron. Other materials contemplated are polymer concrete or ceramics.

As indicated above, the underlying concept of the present invention renders it possible to provide a proof printer operating in accordance with the internal drum laser image concept, by providing a laser means comprising three lasers. In this case, the three lasers comprise a red laser, a green laser and a blue laser, and the optical fiber means comprises three separate optical fibers connected to the red laser, the green laser and the blue laser, respectively.

The red laser is suitably constituted by a red HeNe laser generating laser light of wavelength about 633 nm, or a red diode laser generating laser light of wavelength about 635 nm or of about 670 nm; the green laser is suitably constituted by a green HeNe laser generating laser light of wavelength about 543.5 nm, a green frequency-doubled Nd:YAG laser generating laser light of wavelength about 532 nm, or a green argon ion laser generating laser light of wavelength about 514.5 nm; and the blue laser is suitably constituted by a blue argon ion laser generating laser light of wavelength about 488 nm, a blue HeCd laser generating laser light of wavelength about 441 nm, or a frequency doubled diode laser generating laser light of wavelength about 420 nm.

Alternatively, for providing a single colour photographic exposure of a photographic film, e.g. in a YMCB (yellow magenta, cyan and black colour system), a single infra red (IR) laser, preferably a diode laser, or a single argon ion laser may be provided. The argon ion laser is the more expensive, but the photographic film used therefor is cheaper than the film used for the IR laser, and the argon ion laser provides the higher quality, i.e. a better defined light spot.

With an IR diode laser, the accurate switching on and off of the laser beam during the exposure process can be performed by simply activating and deactivating the laser. In order to render it possible to accurately switch the light beam emitter from the laser light beam on and off the laser means of the apparatus according to the present invention preferably comprises acousto-optical modulator means controlled by the central control means, such acousto-optical modulator means functioning by modulating the refractive index of a prism through which the laser beam passes, thus directing the laser beam in and out of the light path of the apparatus, respectively.

BRIEF DESCRIPTION OF THE DRAWINGS

The present invention will now be further described with reference to the drawings, in which

FIG. 4 is an overall schematic view illustrating a block diagram of the electronic circuitry of the internal drum laser image setter and also disclosing peripheral equipment with which the electronic circuitry of the internal drum laser image setter communicates, and FIGS. 5, 6, 7 and 8 are block diagrammatical views of separate sections of the electronic circuitry of the internal drum laser image setter.

DESCRIPTION OF THE PREFERRED EMBODIMENTS

Figure 1:
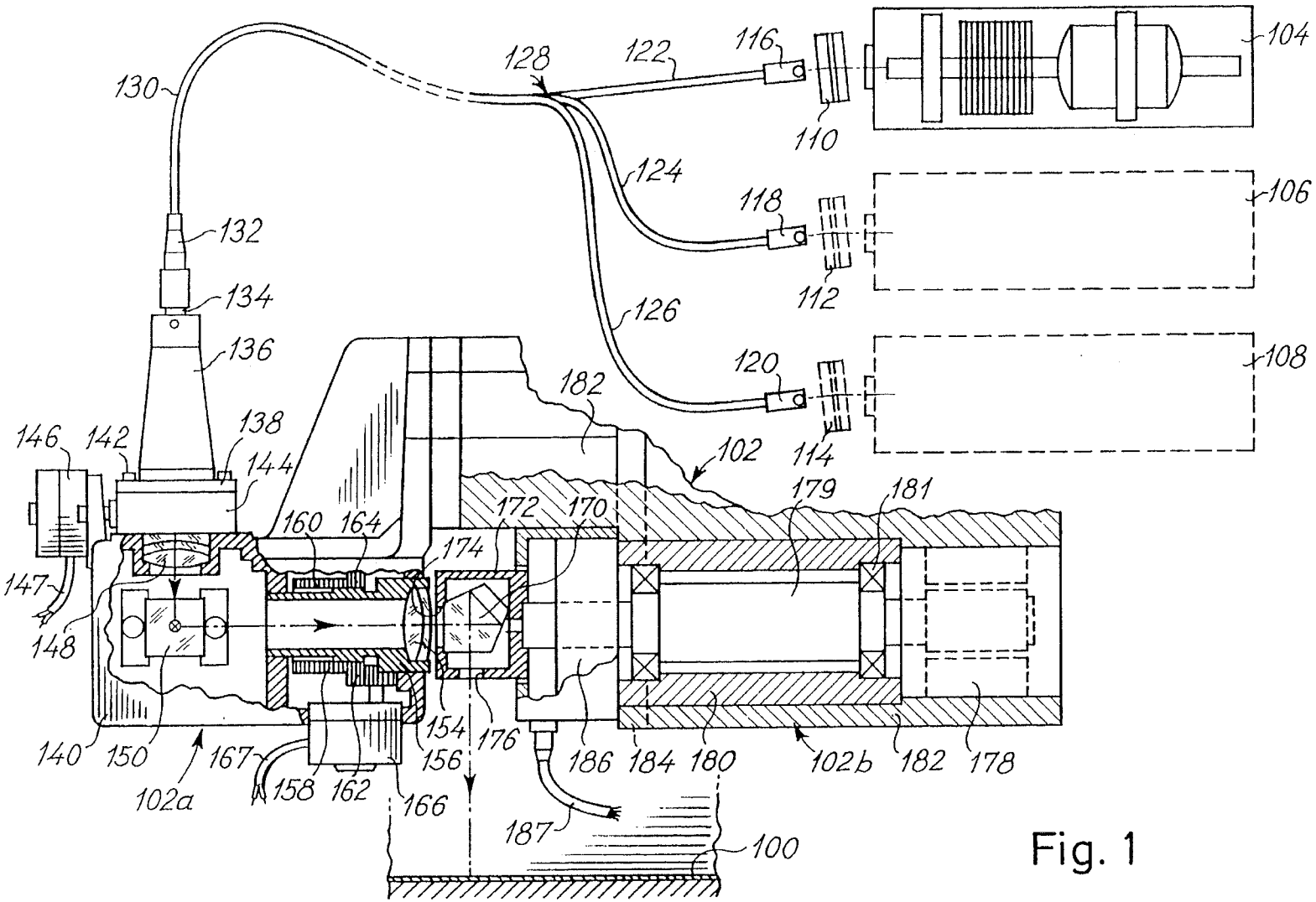
FIG. 1 is a perspective and partly broken away view of a fiber-optical laser system interconnecting one or more lasers and a light-directing assembly of an apparatus according to the invention, that is, an internal drum laser image setter.

In FIG. 1, a schematic and partly broken away view of an internal drum section of an internal drum laser image setter is shown disclosing a wall section 100 of the internal drum of the internal drum laser image setter, through which internal drum a light-directing assembly 102 is movable. The internal drum laser image setter is a high speed, high resolution laser image setter. The light-directing assembly 102 is journalled in bearings to be described in greater detail below with reference to FIG. 2*a* and is movable in the longitudinal or axial direction of the internal drum of the internal drum laser image setter. The light-directing assembly 102 comprises two sections, one of which, designated by the reference numeral 102*a*, is shown in the lower left-hand part of FIG. 1 and constitutes an optical section, and another one of which, designated by the reference numeral 102*b*, is shown in the right-hand lower part of FIG. 1 and constitutes a motor and spinner prism section. The optical section 102*a* of the light-directing assembly 102 comprises a plurality of optical elements which serve the purpose of generating a narrow light beam and focussing and directing the light beam to a specific point of the internal drum wall 100. In FIG. 1, a dash and dot line with arrows indicates the light beam which is guided or directed through the optical section 102*a* of the light-directing assembly 102 by the optical elements thereof.

The light which is concentrated into a light beam and further directed through the optical section 102*a* as indicated above is generated by a laser 104 shown in the upper right-hand part of FIG. 1.

The internal drum laser image setter shown in the drawings may constitute a single-colour printing internal drum laser image setter for providing an optically exposed film by exposure of the photographic film to light of a single wavelength generated by a single laser.

Alternatively, the internal drum laser image setter shown in the drawings may comprise several lasers, such as three lasers constituting an RGB (red, green, blue) light system, by means of which a so-called proof print may be provided by exposing a colour film to RGB colours generated by the three lasers generating red, green and blue light, respectively, which lasers are activated in accordance with an RGB colour picture representation generated by a computer graphic system to which the internal drum laser image setter is connected, as will be described in greater detail below with reference to FIGS. 4–8. The internal drum laser image setter comprises three lasers constituting an RGB (red, green, blue) light system and may additionally or alternatively generate colour prints such as separate colour prints for future colour printing operations, such as separate YMCB (yellow, magenta, cyan and black) prints. For providing a yellow, a magenta, a cyan or a black print, the RGB lasers are activated in accordance with a predetermined converter scheme for converting the RGB representation into separate YMCB prints.

The internal drum laser image setter may comprise an arbitrary number of lasers, such as four lasers, for generating a four-colour print representation, e.g. in YMCB (yellow, magenta, cyan and black) representation.

In accordance with the teachings of the present invention, the laser or lasers are preferably physically located at a position remote from the optical assembly 102, such position helps to reduce or eliminate impingement of heat from the laser or lasers on the light-directing assembly and further on the internal drum and bearings and journalling elements of the internal drum laser image setter. Lasers may generate a large amount of heat. Thus, a blue light laser radiating 15 mW light receives 1 kW electrical power and consequently generates approximately 1 kW of heat. If such a laser were arranged immediately adjacent to the light-directing assembly, the release of this large amount of heat would result in a correspondingly high impingement of heat on the light-directing assembly, on the journalling and bearing elements and also on the photographic film.

The laser or lasers, one of which is shown in full line and designated the reference numeral 104 and a second and a third of which are shown in dotted line and designated the reference numerals 106 and 108, respectively, constitute e.g. a blue, a green and a red laser, respectively, and are provided with external acousto-optical modulators 110, 112 and 114, respectively. It is to be mentioned that in the event of one of the lasers, e.g. the red light laser 108, being implemented as a diode laser, the acousto-optical modulator 114 may be emitted. The light generated by the lasers 104, 106 and 108 is directed through the acousto-optical modulators 110, 112 and 114, respectively, which modulate the light generated by the respective laser, unless (as mentioned above) the laser is a diode laser. If so, the acousto-optical modulator is omitted, as the diode laser may generate modulated light.

The light generated by the lasers 104, 106, 108 and modulated by the acousto-optical modulators 110, 112 and 114, respectively, is received by fiber-optical input couplers 116, 118 and 120, respectively, which are connected to optical fibers 122, 124 and 126, respectively. The optical fibers 122, 124 and 126 are combined in a fiber-optical joint 128 into a single fiber-optical conductor 130, which is provided with a fiber-optical connector 132 at its remote end.

The fiber-optical connector 132 cooperates with a fiber-optical receptacle 134, which constitutes a component of the optical section 102*a* of the light-directing assembly 102. The fiber-optical receptacle 134 is arranged on a spacer component 136, which constitutes a hollow, substantially frustoconical element provided with a flange component 138 which is screwed onto a housing component 140 of the optical section 102*a* by means of screws 142 with interconnection of an iris component 144. The iris component 144 is a motor-driven component, which internally includes an iris element for providing a predetermined and highly accurate adjustment of the width of the light beam transmitted therethrough. The motor driving the iris component 144 is an external motor 146, which is connected to a central control system of the laser image setter through an electric cable 147, as will be described in greater detail below.

The light beam transmitted from one of the lasers 104, 106 or 108 through the fiber-optical transmission system comprising the above-described fiber-optical elements is emitted from the fiber-optical conductor 130, which in this embodiment constitutes the laser light-emitter. The laser light beam diverges when emitted from the fiber-optical transmission system. The divergent beam is directed to a convergent lens 148, which is mounted in a support structure of the housing component 140. Upon passing through the convergent lens 148, the beam is collimated so that it substantially neither diverges or converges. The collimated light beam directed from the lens 148 is directed to a first optical prismatic element 150, from which the light beam is directed to a second optical prismatic element 152, which is not shown in FIG. 1, but is disclosed in the lower left-hand part of FIG. 2. The light beam transmitted through the first and the second optical prismatic elements 150 and 152 is directed through a focusing lens 154, which is mounted on a separate, movable component 156. The separate component 156 is provided with two toothed racks 158 and 160, which mesh and cooperate with two toothed wheels 162 and 164, which are journalled on an output shaft of an electric motor 166. The electric motor 166 is provided with an electric cable 167 for connection to external controlling circuitry to be described in greater detail below.

As will be readily understood, component 156 supporting the focusing lens 154 may be moved to and from the optical prismatic system comprising the first and the second optical prismatic elements 150 and 152 by activating the electric motor 166, causing the output shaft thereof to rotate in a first direction or in a second, opposite direction. Focussing of the laser light beam (on the light-sensitive surface of the material in the internal drum) is normally performed when the type of the film or foil comprising the light-sensitive material, such as the type of photographic film, is changed, with resulting change in the thickness of the material or its light-sensitive layer, and normally comprises a series of test exposures on the basis of which the focussing is optimized.

The light beam directed from the focusing lens 154 is directed to an optically reflecting element 170, such as a pentaprism. The optically reflecting element 170 is mounted in and supported by a separate supporting component 172, which is provided with two apertures 174 and 176, and which is fixed on a rotatable output shaft 179 of a motor 178 which constitutes an element-rotating motor. The element-rotating motor 178 is preferably a 3-phase, 4-pole DC brushless motor. The rotatable shaft of the element-rotating motor 178 is journalled in bearings 181, which are supported by a shaft housing 180. An encoder 186 is constituted by a rotatable disc and a stator part, not shown in the drawing, the stator part being fixed to the shaft housing 180, and the rotatable disc being fixed to the rotatable shaft of the element-rotating motor 178. The encoder component 186 serves the purpose of providing an electrical signal by means of an optical encoder element; this electrical signal represents the angular position of the output shaft 179 of the element-rotating motor 178, and consequently of the supporting component 172 and of the optically reflecting element 170. The electrical signal is supplied to the central control system of the laser image setter through an electric cable 187, as will be described in greater detail below. A light-directing assembly housing part 182, provided with bores of different diameter, supports the motor 178 and the shaft housing 180, and to this light-directing assembly housing part is also rigidly fixed the housing part 140 of the optical section 102*a* of the light-directing assembly 102, so that the two parts together constitute the light-directing assembly housing of the apparatus.

By the rotation of the output shaft 179 of the element-rotating motor 178, and thus the rotation of the optically reflecting element 170, the light beam directed to the optically reflecting element 170 through the aperture 174 is directed through the aperture 176 towards the internal drum wall 100. Consequently, provided the light generated by one of the lasers 104, 106 and 108 is modulated, an extremely precisely focussed light spot is generated at the internal drum wall 100 as the optical prismatic element 170 is rotatingly driven by the output shaft 179 of the element-rotating motor 178, this extreme high precision focusing being accomplished by the extremely short light transmission path from the iris component 144, through the divergent lens 148, through the first and the second optical prismatic elements 150 and 152, respectively, through the focusing lens 154 and further through the rotating prismatic element 170, this optical transmission path being independent of the position of the light-directing assembly 102 comprising the optical section 102*a* and the element-rotating motor 178, the encoder 186 and rotatable prism section 102*b*.

As described above, in conventional internal drum laser image setters, a single laser is arranged at one end of the internal drum of the internal drum laser image setter, from which single laser a light beam is input to a focusing lens of a movable light-directing assembly, this movable light-directing assembly being moved within the internal drum of the internal drum laser image setter with the result that the optical transmission path is altered and varies when the light-directing assembly is moved away from or towards the light-generating laser. In contrast thereto, the optical transmission path of the internal drum laser image setter according to the present invention is independent of the actual position of the light-directing assembly relative to the longitudinal axis of the internal drum of the internal drum laser image setter, since the light generated by the laser or lasers is transmitted through a fiber-optical system to the iris component of the optical system, this iris component being arranged at a fixed or predetermined distance from the remaining optical components of the focusing and light-beam-directing optical system, such as the divergent lens 148, the first and second optical prismatic elements 150 and 152, respectively, the focusing lens 154 and the optical prismatic element 170. An extremely by high focusing precision is consequently obtained by the fiber-optical laser light transmission system characteristic of the present invention.

As described above, a further advantage of the fiber-optical laser light transmission system characteristic of the present invention is the elimination of any heat impingement on the mechanically extremely delicate high-precision components of the light-directing assembly, since the laser or lasers are physically well-separated from the optical system and the spinner system.

Figure 2A:
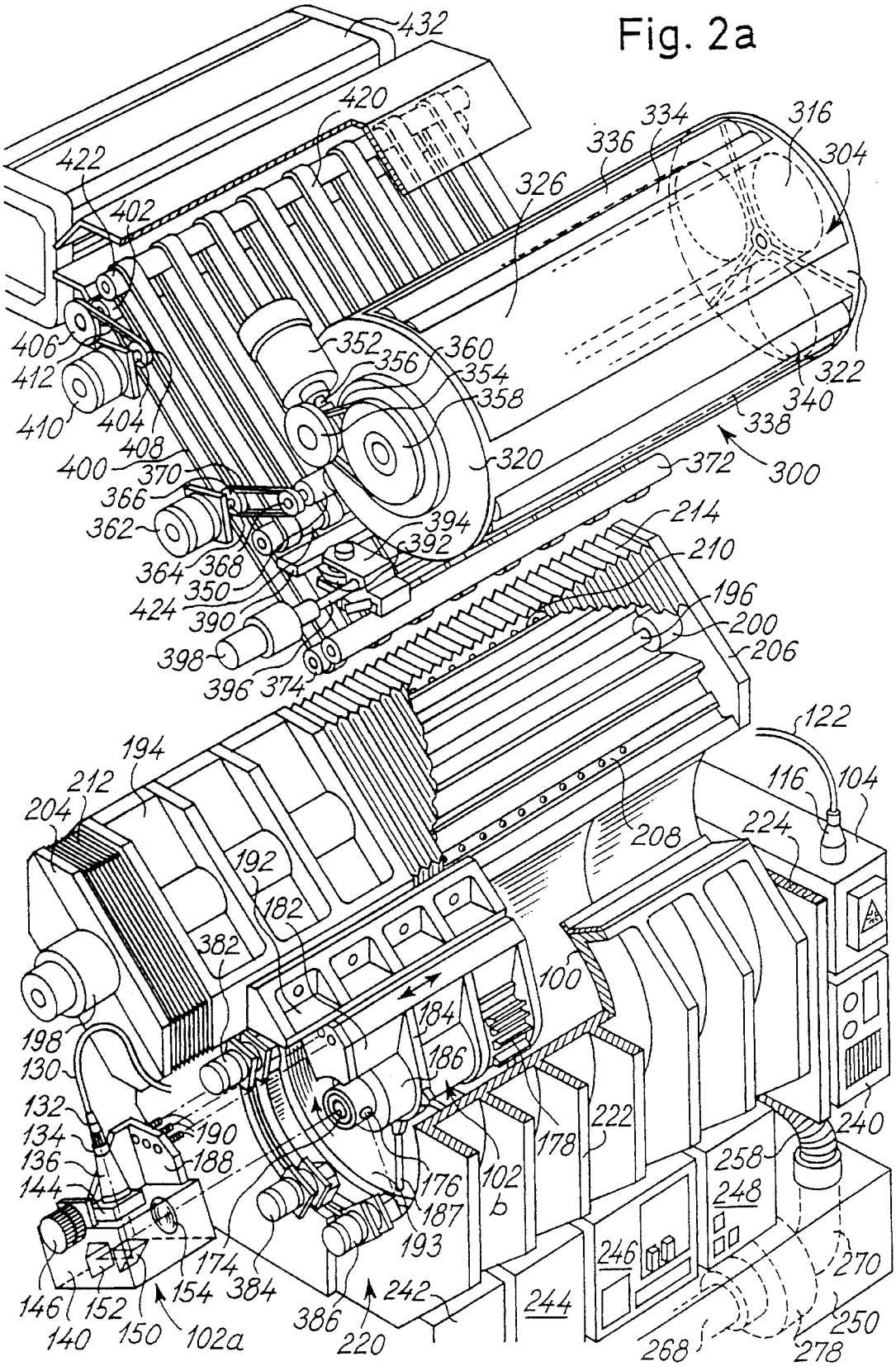
FIG. 2*a* is an elevational, perspective and exploded view disclosing the internal drum of the laser image setter, the light-directing assembly shown in FIG. 1, the fiber-optical laser system also shown in FIG. 1, a laser, a film loader section, and part of an air conditioning plant.

In FIG. 2*a*, an elevational, perspective and exploded view of the mechanical structure of the internal drum laser image setter is shown. In FIG. 2*a*, the optical section 102*a* of the light-directing assembly 102 is separated from the element-rotating motor 178, the encoder 186 and rotatable prism section 102*b* of the light-directing assembly 102. As is evident from FIG. 2*a*, the optical section 102*a* is fixed relative to the light-directing assembly housing 182 of the light-directing assembly 102 by means of a bracket 188, which is fixed relative to the light-directing assembly housing 182 by means of screws 190. The light-directing assembly housing 182 is fixed to a support bracket 192, which is further fixed to a carriage 194. The carriage 194 is provided with a part having an internal thread, which is not shown in FIG. 2*a*, but which is disclosed in FIG. 3*b* and FIG. 3*c*, which internally threaded part meshes with a threaded rod 196. The threaded rod 196 constitutes a drive rod, disclosed in detail in FIG. 3*c*, which is rotated by means of a motor 198, which is arranged at one end of the threaded drive rod 196, the opposite end of which is journalled in a bearing 200. When the threaded rod 196 is caused to rotate by activation of the electric motor 198, the carriage 194 is also caused to move, which further causes the light-directing assembly 102 to move in a direction parallel with the longitudinal axis of the threaded rod 196.

The threaded rod 196 is, as indicated above, rotated by an electric motor 198, and journalled in a bearing 200. An apparatus housing 220 is provided with end walls 204 and 206, respectively, which support the electric motor 198 and the bearing 200, respectively, and which apparatus housing 220 is provided with guiding means 208 and 210 extending longitudinally parallel to the central axis. The guiding means 208 and 210, are shown here as, and are preferably, ball-bearing assemblies. The ball-bearing assemblies 208 and 210, cooperate with ball-bearing components of the carriage 194 for generating an extremely accurate, and substantially vibrationless and frictionless motion of the carriage 194, and consequently of the light-directing assembly 102, relative to the apparatus housing 220. Those parts of the apparatus housing 220 (not including the carriage 194) in which the ball-bearing assemblies 208 and 210 and part of the threaded drive rod 196 are positioned are normally covered by bellows components 212 and 214, which are shown partly cut away in FIG. 2*a* so as to disclose the above-described ball bearing assemblies and further the threaded drive rod 196.

The apparatus housing 220 defines the internal drum wall 100, also shown in FIG. 1. To ensure a highly rigid apparatus housing, the apparatus housing 220 is provided with protruding fins, one of which is designated by the reference numeral 222, and with cavities indicated by dot lines in FIG. 3*a*.

To regulate the temperature and the humidity of the critical part of the apparatus, a domain of the apparatus comprising the apparatus housing 220, the light-directing assembly 102 and electronic component housings 242, 244, 246 and 248, is encapsulated and air-conditioned by means of an air-conditioning system, not fully visible in FIG. 2*a*. The encapsulating material is preferably in the form of a thermally insulating plate component 224. One such thermally insulating plate components 224 is shown in FIG. 2*a*. A lower housing component 250 of the air-conditioning system is shown, including a fan 278, which is connected through a return air tube 268 and an injection air tube 270 to an exhaust hose 258. The principle of the air-conditioning system is further disclosed in FIG. 2*b*.

Figure 2B:
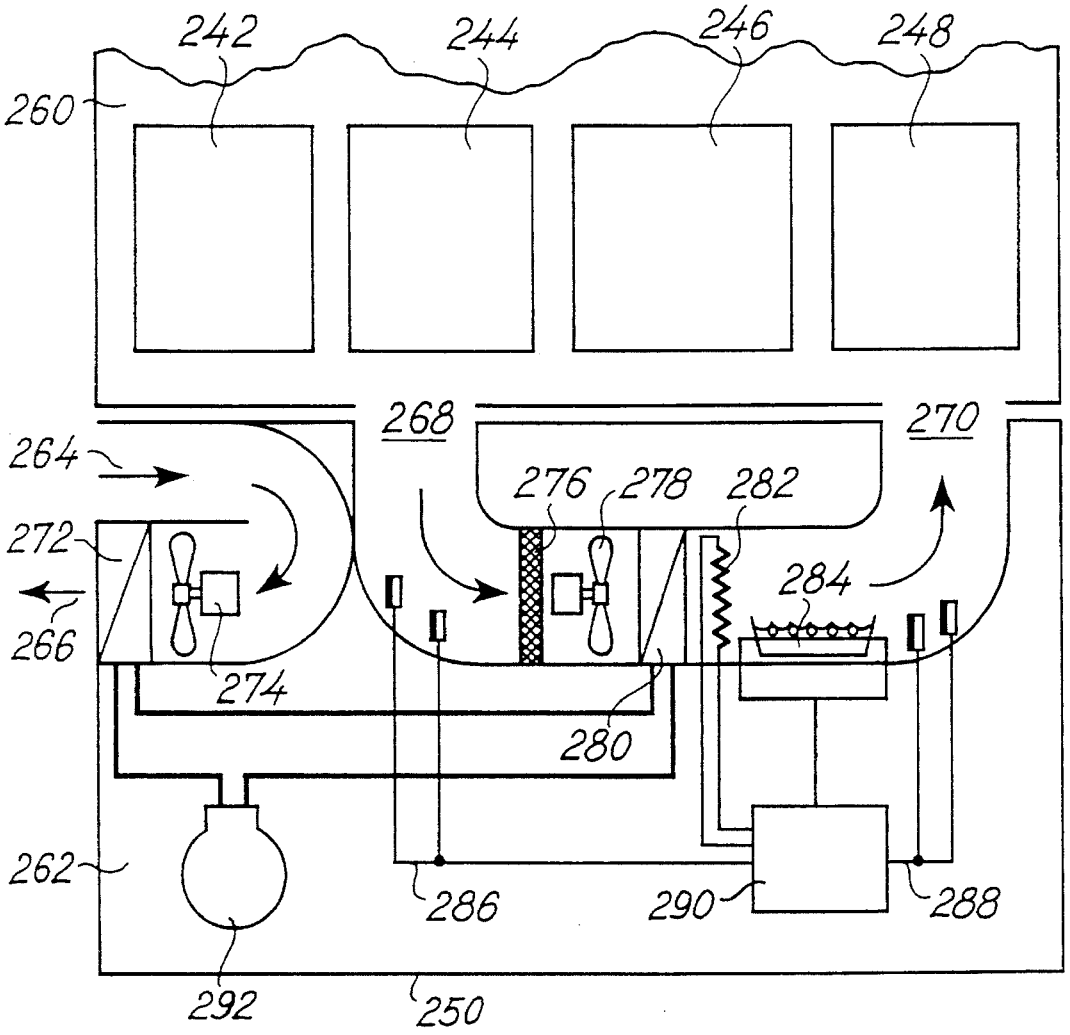
FIG. 2*b* is a drawing showing the principle of the air-conditioning plant also shown in FIG. 2*a*.

In FIG. 2*b*, which illustrates the principle of the air conditioning system 262 within the housing 250, it is to be understood that the encapsulated domain 260 of the apparatus from above the jagged line delimiting the upper part of the figure extends and down to the plane of the openings of the tubes 268 and 270. Air is drawn from the encapsulated domain through the exhaust tube 268 by a fan 278, passed through a filter 276 and over a cooling surface 280, a heating element 282 and a humidifier 284 from which the air, after conditioning as appropriate, passes into the encapsulated domain through the injection air tube 270. The conditioning of the air via activation of the cooling surface and/or the heating element and/or the humidifier is controlled in response to measurements of the temperature and humidity of the air by means of sensing means 286 in the return air and sensing means 288 in the air to be injected by a controller means 290. The cooling surface 280 is cooled by a cooling medium (such as freon or the like) which is subjected to compression/expansion cooling, condensation of the cooling medium taking place in a condenser 272 from which removal of the liberated heat is aided by the operation of a fan 274 drawing air 264 into the system as shown by an arrow and passing air 266 over the condenser 272 as shown by an arrow. The cooling medium is compressed by means of a compressor 292. The cooling surface further serves to condense water from the air to be conditioned when the humidity of this air is too high. This condensed water may be removed by a drain (not shown) and subsequently be discharged from the air-conditioning system for example by evaporation employing heat absorbed by the cooling medium used to cool the cooling surface 280.

As indicated above, the light-directing assembly 102 is moved from a position shown in FIG. 2*a*, this position constituting a first, extreme position, to an alternative extreme position in which the element-rotating motor 178 of the section 102*b* is arranged adjacent to the end wall component 224, the purpose of which will be evident from the description below. The motion of the light-directing assembly 102 is indicated by a dual arrow, while the rotation of the optical prismatic element 170 (shown in FIG. 1) supported by and mounted within the supporting component 172 is indicated by an arrow. As will be readily understood, the light-directing assembly 102 is movable in directions towards and away from the thermally insulating plate component 244 along the longitudinal axis of the internal drum wall 100.

Adjacent to the thermally insulating plate component 244, the laser 104 is shown together with the fiber-optical input coupler 116 and the optical fiber 122. Below the laser 104, a power supply unit 240 is shown, and below the trough-shaped apparatus housing 220, four housings 242, 244, 246 and 248 are shown, these housings including separate electronic sections of the internal drum laser image setter; these electronic sections will be described in greater detail below with reference to FIGS. 4–8.

The support bracket 192 is rigidly connected to a guide component 193, which constitutes a component of a partly circular cylindrical configuration having an outer cylindrical wall which is almost congruent with the internal drum wall 100, but which however, allows a photographic film or a photographic plate to be arranged between the outer cylindrical wall of the guide component 193 and the internal drum wall 100. The guide component 193 consequently serves the purpose of guiding the photographic film so as to maintain the photographic film or at least that part of the photographic film which is to be exposed to the light beam directed from the rotating prismatic element 170 (shown in FIG. 1) in a predetermined position and in a predetermined distance from the longitudinal axis of the internal drum of the internal drum laser image setter.

Figure 3A:
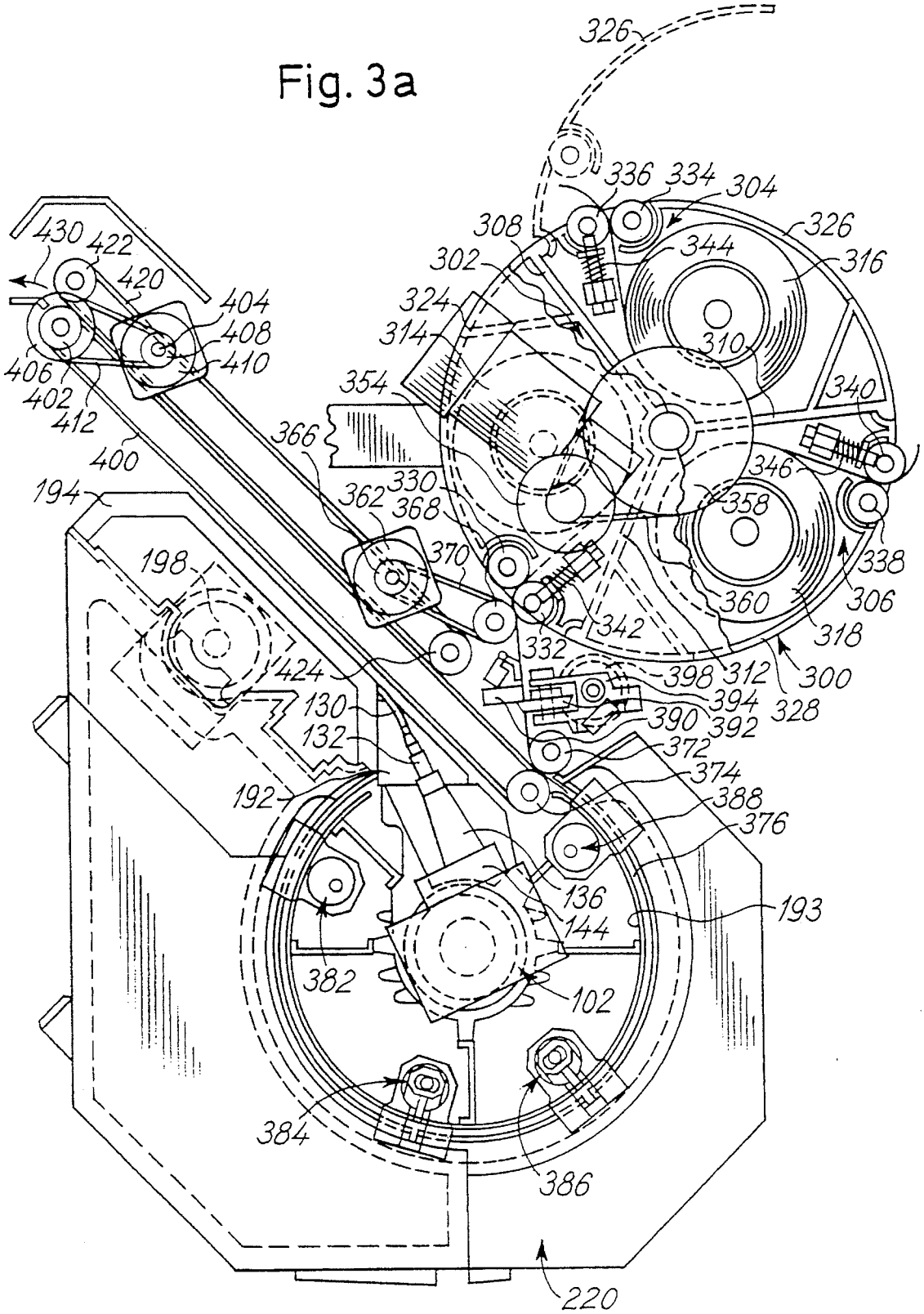
FIG. 3*a* is a elevational, vertical sectional view of the internal drum of the laser image setter disclosing an end view of the light-directing assembly, and also disclosing the film loader section.
Figure 3B:
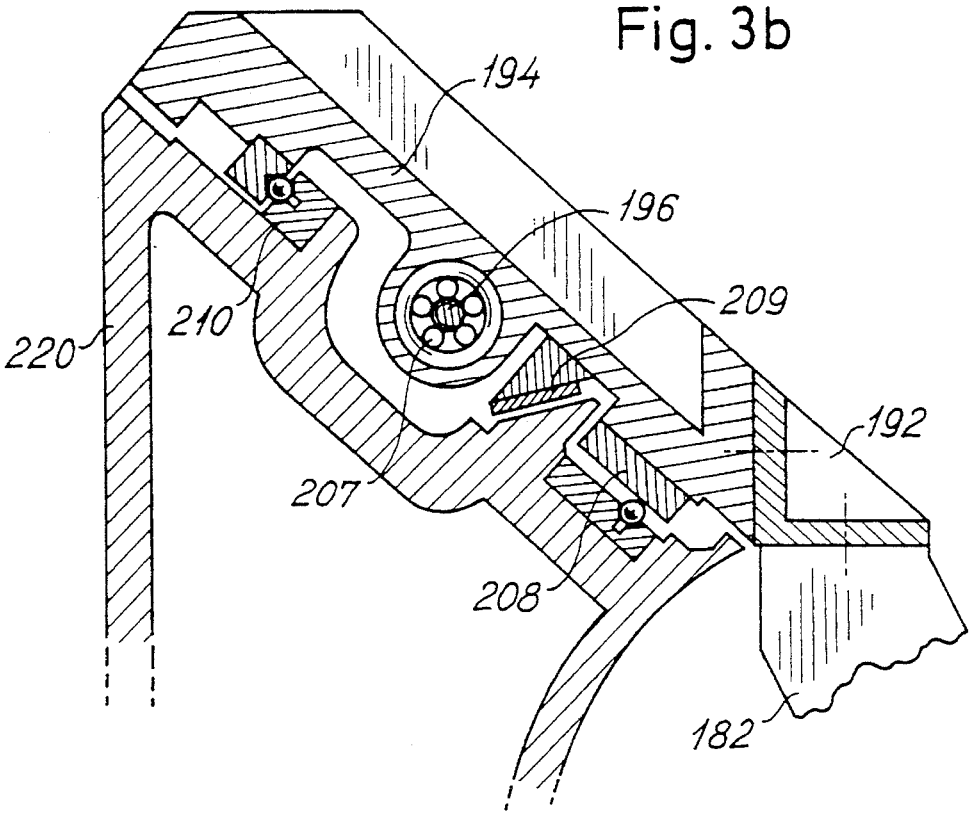
FIG. 3*b* is a elevational, vertical sectional view of part of the apparatus housing of the laser image setter disclosing an end view of the part of the apparatus housing supporting the carriage.

A part of the apparatus housing 220 supporting the carriage 194 is shown in FIG. 3*b*. As evident from FIG. 2*a*, the support bracket 192 is fixed to the carriage 194, and the light-directing assembly housing 182 is fixed to the support bracket 192. The carriage 194 is provided with a recirculating planetary roller 207 meshing with the threaded rod 196. Guiding means 208 and 210 constituted by ball bearing elements support the carriage 194 in a statically determined manner, in that the upper bearing element 210 supports the carriage in a two-plane manner, while the lower bearing element 208 supports the carriage in a one-plane manner. A longitudinally arranged series of magnets 209 contribute to securing the carriage 194 to the apparatus housing 220. The magnetic force and the angle at which the magnets are arranged are preferably adapted to minimize the moment on the threaded rod 196 deriving from frictional forces in the bearing elements 208 and 210. At the same time, the arrangement and strength of the magnets are preferably adapted to compensate for or counteract an added moment along the part of the carriage 194 where the light-directing assembly 102 is arranged. The combination of the bearing elements 208 and 210 and the magnets 209 constituting the statically determined support of the carriage 194 results in a more stable and accurate guiding of the carriage than if the carriage had been supported by two two-plane bearing elements; at the same time, this support system puts less critical demands on the precision of the construction and thus results in a cheaper attainment of a higher accuracy. The preloading provided by the magnets makes the construction less susceptible to vibration or mechanical shock, without interfering with the intended support of the carriage in a statically determined manner.

Figure 3C:
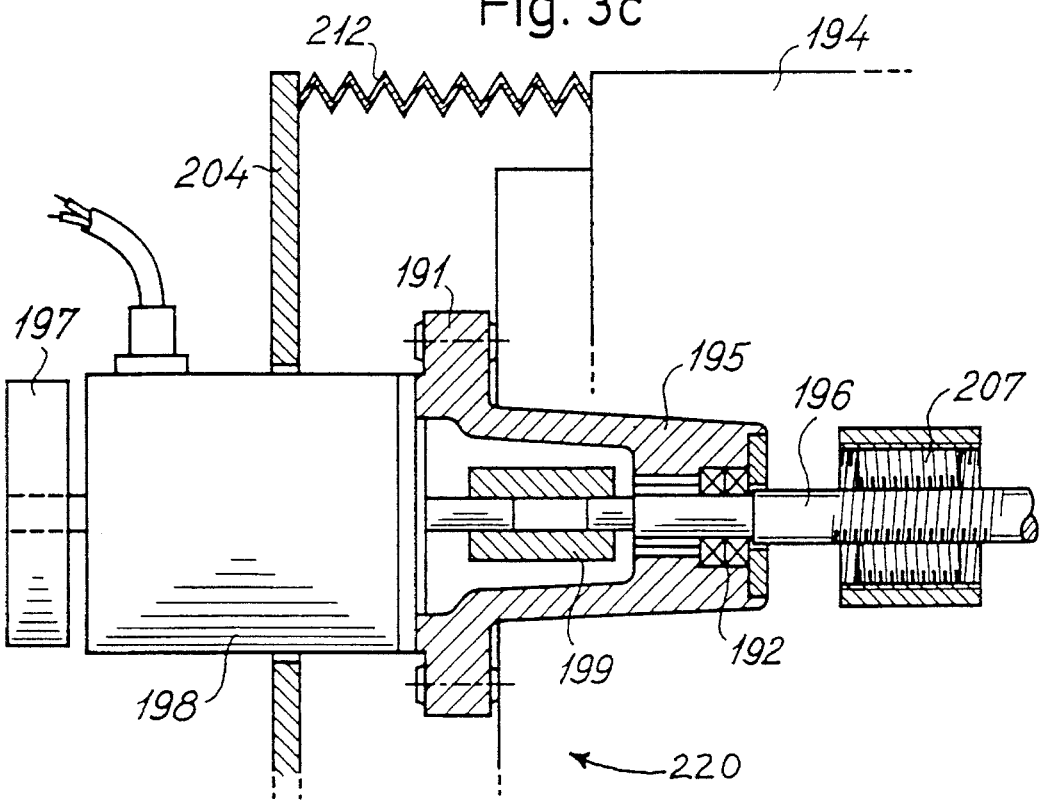
FIG. 3*c* is a elevational, vertical sectional view of the motion means of the laser image setter disclosing a side view of the threaded rod meshing with the carriage and connected to the motor output shaft.

In FIG. 3*c* the motion means of the laser image setter is shown. The motor 198 traverses the wall element 204 of the apparatus housing 220 and is fixed to the apparatus housing 220 via a motor flange 195 which in turn is attached to the apparatus housing 220 by means of screws 191, the motor 198 being provided with a viscous muffler 197 to minimize the vibrations of the motor. A bellows component 212, with one end fixed to the wall element 204 and an other fixed to the carriage 194 covers the guiding means 208 and 210, shown in FIG. 3*b*.

The threaded rod 196 meshing with an internally threaded part of the carriage, in the present embodiment shown as a recirculating planetary roller 207, is journalled in bearings 192 in the motor flange 195 and is rigidly connected to the output shaft of the motor 198 through a clutch 199, such that activation of the motor 198, and thereby rotation of the output shaft of the motor, makes the carriage 194 move.

A photographic film guiding system and the overall operation of photographic film guiding components of the internal drum laser image setter will now be described with reference to FIGS. 2*a* and 3*a*. The photographic film to be exposed by a modulated light beam generated by one of the lasers 104, 106 or 108 and modulated by one of the acousto-optical modulators 110, 112 or 114 (shown in FIG. 1), respectively, is supplied from a photographic film cassette 300 shown in the upper right-hand parts of FIGS. 2*a* and 3*a*. The photographic film cassette 300 is divided into three compartments 302, 304 and 306, these compartments being defined by three partition walls 308, 310 and 312, which constitute an integral component made preferably from an extruded aluminium profile cut to a predetermined length corresponding to the length of the photographic film cassette 300. In each of the compartments 302, 304 and 306, a respective photographic film is arranged. Thus, a photographic film wound on a photographic film support or core constituting a photographic film roller and designated in its entirety by the reference numeral 314 is mounted within the compartment 302. Similarly, photographic film rollers 316 and 318 are received within the compartments 304 and 306, respectively. Apart from the partition wall defining component constituted by the partition walls 308, 310, and 312, the cassette 300 comprises two end wall components 320 and 322 and further three lid components 324, 326 and 328 which are of identical configuration and constitute part of circular cylindrical surface.

The lid components 324, 326 and 328 may be opened as illustrated in the uppermost right-hand part of FIG. 3*a*, where dashed lines represent the lid component 326 in an opened state, whereby access is obtained to the compartment 304, e.g. for servicing the photographic film roller 316 in the event of the photographic film roller 316 not being correctly mounted or journalled within the compartment 304, or for replacing an emptied photographic film roller by a new or fresh photographic film roller.

Apart from the above-described components, two rollers are provided in each of the compartments 302, 304 and 306. Thus, a first pair of rollers 330, 332 is provided in the compartment 302, a second pair of rollers 334, 336 is provided in the compartment 304, and a third pair of rollers 338, 340 is provided in the compartment 306. Each of the roller pairs (330, 332), (334, 336) and (338, 340) is arranged in a longitudinal recess of the lid components 324, 326 and 328, respectively, in which recess a longitudinal aperture is provided for allowing the photographic film, such as the photographic film of the film roller 314 mounted within the compartment 302, to be guided through the rollers 330 and 332 from the compartment 302 to the exterior relative to the compartment. As is evident from FIG. 3*a*, the rollers 330, 334 and 338 constitute fixed rollers, while the rollers 332, 336 and 340 constitute movable rollers, which are acted upon by biassing springs designated by the reference numerals 342, 344 and 346, respectively. The biassing springs 342, 344, 346 are journalled on supporting rods, which are arranged so as to firstly cause the respective, biassed roller to be pressed against the cooperating fixed roller, i.e. one of the rollers 330, 334 and 338, and secondly have the purpose of cooperating with a roller 350 (shown in FIG. 2*a*) of a transport system, which is shown in the central and left-hand part of FIGS. 2*a* and 3*a*, provided the biassed roller in question is positioned adjacent to the transport system.

As will be readily understood, the three-compartment structure of the photographic film cassette 300 allows that the photographic film of the film roller to be removed from a first compartment, such as the compartment 302, as will be described in greater detail below, while in a second compartment, such as the compartment 304, a fresh photographic film roller is substituted for an emptied photographic film core, and while in the third compartment, such as the compartment 306, a photographic film roller is ready to be used for removal of the photographic film through the gap defined between the rollers of that particular compartment after the photographic film roller has been shifted to a position corresponding to the position of the compartment 302 as presently shown in FIG. 3*a*, so that the photographic film may be drawn from the compartment in question.

It is to be realised that in this situation the biassed rollers, such as the roller 340 of the compartment 306, are not cooperating with the roller 350 of the transport system, but are firmly pressing the leading end photographic film end of the photographic film mounted within the compartment in question against the respective fixed roller in order to prevent the photographic film from inadvertently issuing from the compartment 306 whilst it is in a position other than the position (shown in FIG. 3*a*) in which the photographic film 314 is arranged, i.e. whilst in a position different from the position in which the compartment and the photographic film in question are arranged adjacent to and cooperating with the transport system of the internal drum laser image setter.

The shifting of the photographic film cassette 300 from the position shown in FIG. 3*a* to a position in which the photographic film roller 318 is shifted to the position in which the photographic film roller 314 is presently arranged is accomplished by means of an electric motor 352, which cooperates with a drive pulley 354 through a crank drive 356, the drive pulley 354 cooperating with a pulley 358 by means of a belt 360, the pulley 358 being rigidly connected to the end wall component 320 of the film cassette 300. The photographic film is removed from the compartment 302 as the roller 350, which is a drive roller, is caused to rotate by an electric motor 362, which is provided with an output shaft 364, on which a drive pulley 366 is arranged. The drive pulley 366 cooperates with the pulley 368 which is rigidly connected to the roller 350, the pulley 368 being driven by the drive pulley 366 by means of a belt 370.

The photographic film drawn from the photographic film roller 314 in the compartment 302 is guided through two cooperating rollers 372 and 374 and further guided into a narrow annular space, designated by the reference numeral 376, defined between the outer periphery of the guide component 193 and the internal drum wall 100. The photographic film is advanced within the gap or space 376 until the leading end of the photographic film drawn from the photographic film roller 314 is in a position adjacent to the supporting bracket 192.

The positioning of the photographic film within the annular gap or space 376 is detected by means of optical and photoelectrical sensors (not shown in FIG. 3*a*) generating control signals which are processed by the central control processor or control system of the internal drum laser image setter for determining that correct photographic film loading has taken place.

After correct photographic film loading has been established, the photographic film foil received within the gap or space 376 is preferably fixed by means of locking tools, which are shown in FIGS. 2*a* and 3*a* and are designated by the reference numerals 382, 384, 386 and 388, and is secured with vacuum means (not shown in the drawing) to the internal drum wall 100. Such locking tools, when provided, suitably comprise a drive motor (not clearly shown) and a punching plunger (not shown) which is punched through the photographic film foil to form locking holes and kept in an extended or active position in which the photographic film foil is fixed by the punching plungers. The punching of locking holes through the photographic film foil serves an additional purpose, viz. the purpose of defining registering holes, since the photographic foil may constitute a single colour photographic film which is later converted to a single colour printing mask, such as a printing mask of a YMCB colour printing system. As each of the four YMCB photographic films which are later converted to printing masks is provided with punched holes in the above manner the individual photographic film foils and the individual printing masks are thus provided with registering holes which may assist in correctly aligning the printing masks.

A section of photographic film foil loaded in the above manner is cut loose from the photographic film drawn from the roll of film om the roller 314 belt by means of a cutting tool, which comprises a stationary cutting knife 390 and a movable cutting wheel 392. The movable cutting wheel 392 is supported in a substantially U-shaped support structure 394 which is mounted on a threaded shaft 396 and is provided with an internal thread cooperating with the external thread of the threaded shaft 396, the supporting structure 394 being advanced along the stationary cutting knife 390 as the threaded shaft 396 is caused to rotate by an electric motor 398, thereby causing cutting of the photographic film.

After the section of photographic film has been cut loose from the roll of photographic film, the trailing end i.e. the cut-off end of the section of photographic film foil rests on the upper outer surface of a total of eight transport belts 400 which extend from a drive roller 402 to the above-described roller 374. The outer end of the drive roller 402 is provided with a pulley 406 which is driven by a drive pulley 408 of an output shaft 404 of an electric motor 410 by means of a belt 412. Apart from the eight transport belts 400, an additional set of eight transport belts 420 constitutes idler transport belts which are mounted on two idler rollers 422 and 424.

Upon causing the belts 400 to rotate in an anti-clockwise direction, the trailing end of the section of photographic film foil (which has, of course, been released from the punchers or the like of any locking tools such as locking tools 382, 384, 386 and 388) is frictionally engaged by the uppermost surface of the drive belts 400, and the section of film is thus caused to move along the upper side surface of the drive belts 400 and into a narrow space defined between the upper side surface of the belts 400 and a lower side surface of the idler belts 420. The section of the film is discharged from the internal drum laser image setter (as indicated by an arrow 430 in FIG. 3*a*) to a photographic film receiving cassette 432, which is preferably of a design disclosed in Applicant's pending Danish patent application No. 1057/90, to which reference is made. The photographic film receiving cassette 432 includes a motor (not shown) controlled by .the control circuitry of the internal drum laser image setter for winding the section of photographic film foil supplied to the cassette from the internal drum laser image setter.

The internal drum laser image setter shown in the drawings preferably fulfils or conforms to the following requirements or specifications:

| | |
|---|---|
| Recording format | |
| Max.: horizontal × vertical | 26.0 × 20.0 inches or 660 × 508 mm |
| Horizontal: Around drum | |
| Photographic material format | |
| Max.: | 26.2 × 20.9 inches or 665 × 550 mm |
| Min.: | 5.9 × 9.8 inches or 150 × 250 mm |
| Addressability | |
| 1. 50 dpmm = 1270 dpi | |
| 2. 100 dpmm = 2540 dpi | |
| Recording spot size on film | |
| 13 μm at 100 dpmm | |
| 26 μm at 50 dpmm | |
| Air-conditioning tolerances | |
| Temperature: | 22° C. ± 2° C. |
| Relative humidity: | 44% ± 3% RH |
| Register system | |

-continued

| |
|---|
| Customer-specified register along the horizontal sides of the photographic material |
| Photographic material |
| Infrared (IR 780 nm) and blue Argon ion (Argon ion 488 nm) sensitive material on polyester base or paper base. |
| Thickness (TH): 0.10 mm (polyester), 0.18 mm (paper) |
| Photographic material transport |
| Roll to sheet. |
| Possibility of on-line transfer to film processor. |
| Recording resolution = Addressability |
| 50 dpmm |
| 100 dpmm |
| Recording speed |
| 244 $in^2$/min. at 50 dpmm |
| 1572 $cm^2$/min. at 50 dpmm |
| 122 $in^2$/min. at 100 dpmm |
| 786 $cm^2$/min. at 100 dpmm |
| Lasers and fibers |
| Argon ion laser with a wavelength at 488 nm (Siemens 789 LGR). |
| Properties of fiber (YORK SM 450 nm) used together with the argon ion laser: |
| Numeric aperture: 0.12 |
| Length: 3.5 m |
| Diameter of core: 2 μm |
| Cut-off wavelength: 750 nm |
| Diode laser (Sharp LTO 26 MDO) |
| Properties of fiber used together with the diode laser: |
| Numeric aperture: 0.13 |
| Length: 3.5 m |
| Cut-off wavelength: 741 nm |
| Mode field diameter: 5,4 μm |

In FIG. 4, a block diagrammatical view of the electronic circuitry of the internal drum laser image setter is shown, the electronic circuitry being included within a dotted line block 500. The block 500 includes an input/output block 505 which communicates through an optical fiber communication link with a VSB TAXI module 502 (VSB: *VME Subsystem BUS*), (TAXI: Transparent Asynchronous X-mitter receiver Interface module). The VSB TAXI module 502 further communicates with a RIP module 504 (RIP: raster image processor) through a transmission line 503. The RIP module 504 transmits one scan line at a time to the VSB TAXI module 502 and awaits an "acknowledgement" from the laser image setter before transmitting the next scan line. Each scan line consists of a maximum of 16384 bytes (4000 H) for 26.0 inch film and 5 μm resolution.

The fiber optical communication line between the VSB TAXI module 502 and the input/output block 505 is illustrated by two broken-line arrows 507 and 511 illustrating the transmission from the VSB TAXI module 502 to the laser image setter 500 and from the laser image setter 500 to the VSB TAXI module 502, respectively. The fiber optical communication line between the VSB TAXI module 502 and the input/output block 505 is preferably a 100 Mbit/sec, ANSI X 3T9.5 asynchronous optical fiber link communication.

The input/output block 505 includes a BIT BUS TAXI module 513 including a receiver 508 and a transmitter 512 for communicating with a transmitter 506 and a receiver 510, respectively, of the VSB TAXI module 502 and a block 509 constituting a pixel generator module. Centrally, the BIT BUS TAXI module 513 includes a CPU 514 (CPU: central processing unit) of the block 509. Apart from the BIT BUS TAXI module 513, the input/output block 505 includes electronic circuitry included within the dotted-line block 509. The BIT BUS TAXI module 513 communicates with a FIFO module 515 (FIFO: First In First Out), the FIFO module 515 further communicating with an output port 516 which supplies an output signal at a laser output terminal 526 to the laser of the internal drum laser image setter (the laser not being shown in FIG. 4 but being described in greater detail above with reference to FIGS. 1, 2*a* and 3*a*). The block 509 of the pixel generator module of the input/output block 505 of the internal drum laser image setter further includes a CPU 518 which controls the overall operation of the block 505, and which communicates with the CPU 514 of the BIT BUS TAXI module 513 and further with three controllers 550, 552 and 554, through a control communication or data bus line 548. The latter controllers are to be described in greater detail below with reference to FIG. 8.

The CPU 518 also controls a CPU 524 of a motor control module 522 of the block 509 of the input/output block 505, the motor control module 522 also communicating with the FIFO module 515 and further with a PLL circuit 520 (PLL: Phase Locked Loop). The motor control module 522 also communicates with a plurality of terminals 528, 530, 532, 534 and 536 which constitute terminals for connection to an end stop detector, a rotatable shaft controller, an encoder, a step motor controller and a spindle feedback detector, respectively. It is to be realised that the motor control module 522 constitutes a central component of the laser image setter; however, it is a component which is well-known within the art of controlling image setters such as internal drum image setters, and such a motor control module has previously been implemented in alternative laser image setters supplied by the company Purup Electronics A/S.

During the exposure of the photographic film foil received within the internal drum of the internal drum laser image setter, the following functions are controlled by the electronics:

a. Transmission of bit map data from RIP module 504 to the laser 104, 106 and/or 108.

b. Synchronization of bit map data with the rotation of the optical prismatic element 170 of the light-directing assembly 102.

c. Control of light-directing assembly 102.

d. Control of linear actuation or motion of light-directing assembly 102.

modules are used:

a. VSB TAXI module 502 b. BIT BUS TAXI module 513 c. Pixel generator module 509

| Raster image processor (RIP) 504 | |
|---|---|
| Type: | VME module with VSB interface. Complies with VSB revision C specifications. |
| CPU: | Motorola 88000 family. |

CPU: Motorola 88000 family.

Pixel generator module 509 performs four main functions:

a. Conversion of parallel bit map data from BIT BUS

TAXI module 513 to laser serial data.

b. Synchronization of data with rotatable shaft and linear actuation.

c. Control of the light-directing assembly 102.

d. Control of linear actuation or motion of the light-directing assembly 102.

The laser image setter is, in its overall operation, externally controllable from a PC 540 (PC: Personal Computer) including a screen 542, a CPU 544, a keyboard 546 and a mouse (not shown in the drawing), the CPU 544 being connected to the above-described control communication line or data bus 548, with which the CPU 518 of the input/output block 505 also communicates. The PC 540 is preferably an IBM-compatible AT PC which is interfaced with the laser image setter in accordance with the DIDE PC Master/Node Processor Board P/N 52749-400, 375 Wand standard. The controllers 550, 552 and 554 mentioned above constitute a first, a second and a third scanner controller, respectively, for controlling the various mechanical and optical components discussed above. Thus, the first and second scanner controller 550 and 552, respectively, basically control the film transport, i.e. the loading, locking and cutting of the film, since the first and the second scanner controller 550 and 552 control the locking tools 556, a loader 564 and a cutting motor 566 and receive control signals through a film loading detector 562 and a cutter detector 568. The third scanner controller 554 basically controls the laser or lasers 558, the motors of the cassette or magazine 300 and the motors of the cassette 432 and further controls the operation of the laser image setter by means of temperature detectors 560.

It is to be realised that the electronic circuitry configuration shown in FIG. 4 is a presently preferred embodiment of the electronic circuitry implemented for controlling the operation of the laser image setter. However, numerous alternative embodiments and implementations of the electronic circuitry may be employed in accordance with the basic concept and teachings of the present invention.

In FIG. 5, a detailed diagrammatical view of the VSB TAXI module 502 is shown, the module 502 basically comprising a transmitter part and a receiver part included in the upper part and the lower part, respectively, of FIG. 5. For communicating with the transmission line 503, the VSB TAXI module 502 includes a VSB interface 580. The data received from the transmission line 503 from the RIP module 504 are transmitted from the VSB interface 580 to a FIFO module 582, and further transmitted to a parity generator or check module 586 and further to a TAXI transmitter 598 from which the data are output to the data transmitter 506 described above.

The transmission part of the VSB TAXI module 502 also includes a transmitter controller 588 which communicates with the VSB interface 580, the FIFO module 582 and the TAXI transmitter 598. The transmission part of the VSB TAXI module 502 also includes a retransmission controller 584 and a command logic controller 590.

The receiver part of the VSB TAXI module 502 includes a FIFO module 594 corresponding to the FIFO module 582 discussed above, and a command logic controller 592 corresponding to the command logic controller 590 discussed above and communicating with the retransmission controller 584 of the transmission part of the VSB TAXI module 502.

The receiver part of the VSB TAXI module 502 also includes a receiver controller 596 corresponding to the transmission controller 588 discussed above, a parity check module 600 corresponding to the parity check module 586 discussed above, and a TAXI receiver 602 which receives data from the receiver 510 described above. The VSB TAXI module 502 further includes a test loop back block 604 communicating with the VSB interface 580, the TAXI transmitter 598 and the TAXI receiver 602.

The VSB TAXI module 502 conforms to the following requirements:

| | |
|---|---|
| Optical transmission speed: | 100 Mbit/s |
| Data rate: | 80 Mbit/s |
| Oscillator: | Frequency: 8.900 MHz<br>Resonance: parallel mode<br>Tolerance: better than 0.1% |
| Optional when changing crystal osc. FIFO'S, etc.: | |
| Optional transmission speed: | 40 Mbit/s ≦ Speed ≦ 125 Mbit/s |
| Oscillator frequency: | 4 MHz ≦ f ≦ 12.5 MHz |
| Data/command: | 9 bit data<br>3 bit command |
| Transmitter | |
| FIFO size: | 1 scan line = 4 k × 32 bit |
| Output to parity gen.: | 4 × 8 bit multiplexed with MSB first |
| Retransmit: | FIFO has a retransmission function |
| Receiver | |
| FIFO size: | 256 × 8 bit |
| Transmitter | |
| Parity generated during transmission. | |
| Parity: | even |
| Data width: | 9 bit |
| Receiver | |
| Parity check at receiver. | |
| Parity: | even |
| Data width: | 9 bit |

Transmitter

When a NACK (Not Acknowledge) is received from the laser image setter, the VSB TAXI module 502 retransmits the transmission. Retransmission is controlled by hardware by using the retransmission facility on the FIFO. For each retransmission a counter is updated. The counter can be read and reset from the RIP module 504. Apart from reading the counter, the RIP module 504 does not take further part in the retransmission.

When a TAXI START command is transmitted, the VSB TAXI module 502 receives either an ACKS (Acknowledge) or a NACK. This is controlled by the hardware. The RIP module 504 does not take part in it. When ACKS is received, data are transmitted until the FIFO is empty.

When a TAXI END command is transmitted, the VSB TAXI module 502 receives either an ACKE (Acknowledge) or a NACK. This is controlled by hardware as well as software. By ACKE an interrupt is generated and transmitted to the RIP module 504, indicating that the transmission has been transmitted successfully.

Receiver

The module checks the communication for the following errors:

1. Violation on data and command
2. Parity errors

The two error types are checked by hardware and by software. Check sum errors can be checked by software.

For all three error types, the module generates a NACK (Not Acknowledge). NACK is always generated by software.

The fiber optical communication line 507/511 between the VSB TAXI module 502 and the BIT BUS TAXI module 513 fulfils the following requirements:

| Transmitter and receiver | |
|---|---|
| Optional transmission speed: | Normal: 100 Mbit/s<br>Optional: 125 Mbit/s |
| Encoding: | ANSI X3T9.5 (FDDI) |
| Wavelength: | 1305 nm < λc < 1380 nm |
| Bit Error Rate: | $<10^{-12}$ |

Figure 6:
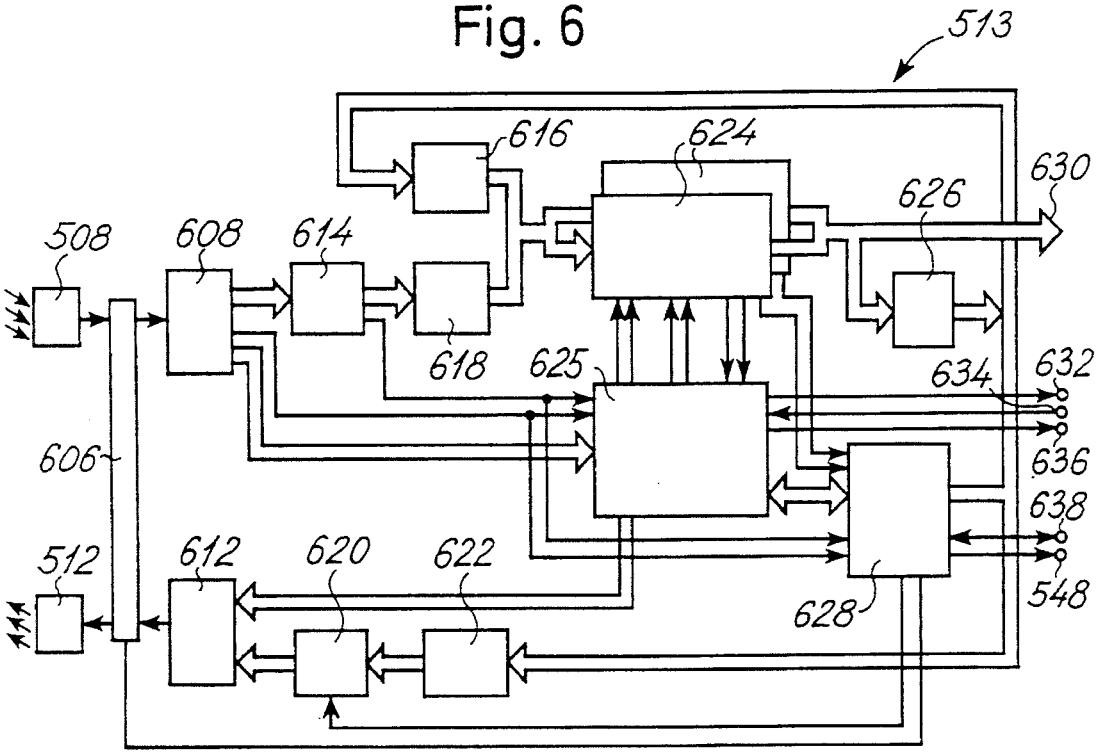
Figure 7:
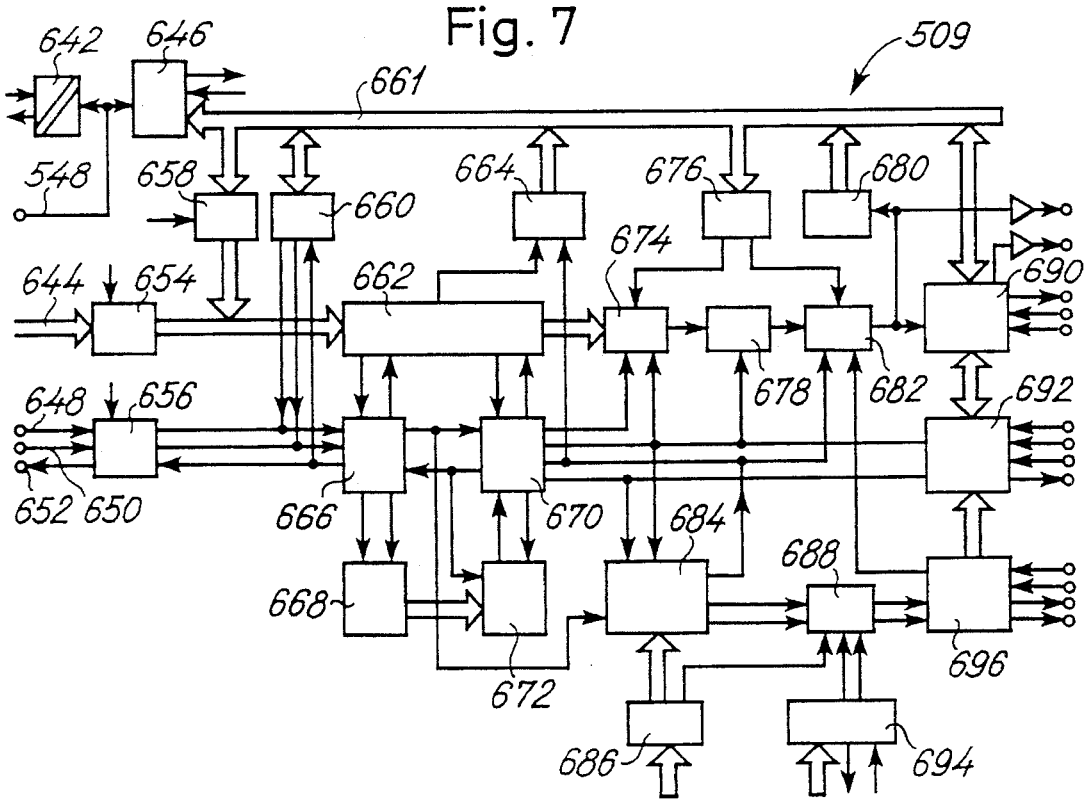

In FIG. 6, a detailed block diagrammatical view of the BIT BUS TAXI module 513 shown in FIG. 4 is disclosed. The BIT BUS TAXI module 513 comprises a loop back selector 606 connected to the receiver 508 and the transmitter 512 also shown in FIG. 4 and further interfacing the receiver 508 and the transmitter 512 relative to a TAXI receiver 608 and a TAXI transmitter 612. Like the VSB TAXI module 502 described above with reference to FIG. 5, the BIT BUS TAXI module 513 disclosed in FIG. 6 comprises a receiver and a transmitter part shown in the upper and the lower parts, respectively, of FIG. 6. Thus, the receiver part further comprises a parity check block 614 which is connected to the TAXI receiver 608 and further to a buffer 618. The buffer 618 is connected to a port 616 and further to a dual FIFO block 624, which communicates with a port 626 and is connected to a program data bus 630.

Centrally within the BIT BUS TAXI module 513 there is provided a FIFO read/write controller 625 which communicates with the above-described TAXI receiver 608, the FIFO block 624, the TAXI transmitter 612 of the transmitter part of the BIT BUS TAXI module 513 and further a BIT BUS block 628 including an internal controller or a CPU, an error counter and a watchdog of the transmitter part of the BIT BUS TAXI module 513. The FIFO read/write controller 625 is further connected to three program controller terminals 632, 634 and 636. The BIT BUS block 628 is connected to a program terminal 638 and further connected to the BIT BUS 548 discussed above with reference to FIG. 4. The transmitter part of the BIT BUS TAXI module 513 shown in the lower part of FIG. 6 further includes a parity generator 620 and a port 622, the port 622 being interfaced with and communicating with the port 616 of the receiver part (shown in the upper part of FIG. 6) of the BIT BUS TAXI module 513. The port 622 is connected to the parity generator 620, which is also connected to and communicates with the BIT BUS block 628. The BIT BUS TAXI module 513 fulfils the following requirements:

| TAXI communication | |
|---|---|
| Optical transmission speed: | 100 Mbit/s |
| Data rate: | 80 Mbit/s |
| Oscillator: | Frequency: 8.900 MHz<br>Resonance: Parallel mode<br>Tolerance: better than |
| Optional when changing crystal osc., FIFO'S, etc.: | |
| Transmission speed: | 40 Mbit/s ≦ Speed ≦ 125 Mbit/s |
| Crystal frequency: | 4 MHz ≦ f ≦ 12.5 MHz |
| Data/command: | 9 bit data<br>3 bit command |

Receiver

The module checks the communication for the following errors:

1. Violation on command
2. Violation on data
3. Parity errors
4. FIFO overrun

For violation on data and parity error the module must generate a NACK (Not Acknowledge) when errors occur. Every time a violation on data or parity error is registered, a 16 bit counter is incremented (one for each error type). In this way it is possible to read the number of transmission errors from the CPU. This feature is only legal for data rate up to 80 Mbit. The counter can also be reset from the CPU.

Transmitter

When a NACK is received from the work station, the CPU must retransmit the data. Retransmission is controlled by software.

The FIFO 624

Consists of 2 separate FIFO's. Transmissions are read into the two FIFO's alternately.

FIFO: 2 * 16 k * 8

Controlled by the READ/WRITE Logic unit 625 and the BIT BUS block 628 including the CPU and the watchdog.

The CPU of the block 628 can read data into as well as data from the FIFO.

Parity check

Parity check on transmit as well as receiving channel.

Parity: even

READ/WRITE Logic

Controls the data flow from the TAXI module 513 to the pixel generator 509 by means of TAXI commands. The CPU of the block 628 acts only as a monitor.

| CPU | |
|---|---|
| CPU: | 8044 BIT BUS Enhanced Micro controller |
| RAM: | 2 * 32 k * 8 or<br>1 * 128 k * 8 |

Selected by strapping.

Monitoring

The BIT BUS CPU has the superior control of the module. The CPU has the following functions:

1. Control of the BIT BUS communication
2. Control of TAXI commands
3. Transfer of film data via the BIT BUS
4. Monitoring of bit map transfer
5. Built-in self test In FIG. 7, a detailed diagrammatical view of the block 509 constituting a pixel generator module shown in FIG. 4 is disclosed.

The block 509 includes a driver 642 communicating with the BIT BUS 548 and a Pixel data input 644, the data bus 548 and the Pixel data input 644 being connected to a first CPU or a BIT BUS CPU 646 and a first port 654, respectively. The first CPU or BIT BUS CPU 646 is preferably implemented as a 8044 microprocessor. The block 509 is further provided with three WRITE control terminals 648, 650 and 652, which are connected to a second port 656. The block 509 includes an internal data bus 661 which communicates with the above mentioned first BIT BUS CPU 646, further a third port 658, a fourth port 660, a fifth port 664, a sixth port 676 and a seventh port 680, and still further a laser controller 690. The third port 658 is connected to the first port 654 and further to a FIFO 662, which is provided centrally within the block 509. The fourth port 660 and the second port 656 are connected to a first write control block 666; the is further connected to a second write control block 668, the first write control block 666 is also connected to a first read control block 670, which is connected to the FIFO 662 and also connected to a second read control block 672. The output of the FIFO block 662 is connected to a SHIFT register 674, which is also connected to the sixth port 676, the first read control block 670, and also to a rotatable-shaft controller 692 which also communicates with the laser controller 690 through a data bus and with a step-motor controller 696 through a data bus. The step-motor controller 696 further communicates with a Pixel controller 682 which is interfaced between a synchronising generator 678 and the laser controller 690, the synchronising generator 698 being connected to the output of the shift register 674 and also communicating with the first READ control block 670. The first WRITE control block 666 and the first READ control block 670 also communicate with a linear movement controller 684, which is interfaced to the first CPU 646 through a seventh port 686. The linear movement controller 684 is interfaced with the step-motor 696 through a data selector 688, which is further interfaced with the first CPU 646 through a second CPU 694. The laser controller 690, the rotatable-shaft controller 692 and the step-motor controller 696 generate control signals to the laser, the light-directing assembly and the step motor, respectively, described above, and also receive control data and signals from appropriate detectors, such as encoders, optical detectors, proximity detectors, etc., through inputs and outputs, respectively. The block 509 or pixel generator shown in FIG. 7 fulfils the following requirements:

FIFO 662

Bit map data from the BIT BUS TAXI module 513 are read into the FIFO 662.

Size: 1 scan line=16 K×8

Speed: 4 Mbyte/s

While one scan line is clocked into the laser, another scan line must be read in order to avoid an exposure interruption.

Full and Empty flags can be read from the BIT BUS CPU 646.

Shift register 674

Bit map data from the FIFO 662 are transformed into serial form by means of a pixel clock (PCLK). MSB (Most Significant Bit) (Data 7) is clocked first.

Serial signals are controlled by the BIT BUS CPU 646.

Pixel control a. Serial data are synchronized completely with PCLK by the synchronizing generator 678 which includes a flip-flop.

b. Positive or negative film. Signals are transmitted via an XOR (Xclusive OR) gate. Controlled by the BIT BUS CPU 646.

c. On/off control of the laser 104, 106 and/or 108 by means of the BIT BUS CPU 646.

d. Default data control.

WRITE control

Controls reading of bit map data into the FIFO 662. For every byte written into the FIFO 662, WRITE COUNT adds 1.

READ control

Controls the superior synchronization of the pixel generator 509.

All synchronizing signals are generated from 5 signals.

| | |
|---|---|
| input | 1. Pixel clock (PCLK) |
| | 2. Logic zero pulse |
| | 3. Terminal count |
| | 4. Ready |
| | 5. RUN/STOP |
| output | 1. FIFO-RD |
| | 2. Shift register - load |

Signal description

1. Input

1. PCLK. Generated by PLL from a spinner encoder. Frequency: 32 MHz.
2. Zero pulse. Generated by offset counter. 1 pulse per spinner revolution=1 pulse per scan line. Frequency: 200 Hz.
3. Terminal count. Generated by read counter. Signals when there are no more bytes in the scan line.
4. Ready. Request from write control to start a new scan line.
5. RUN/STOP. FIFO-RD and shift register load are not generated when RUN/STOP signals stop.

Output

1. FIFO-RD. Request to FIFO to read a byte.
2. Shift register load. Request to shift register to read a byte from FIFO to shift register.

Figure 8:
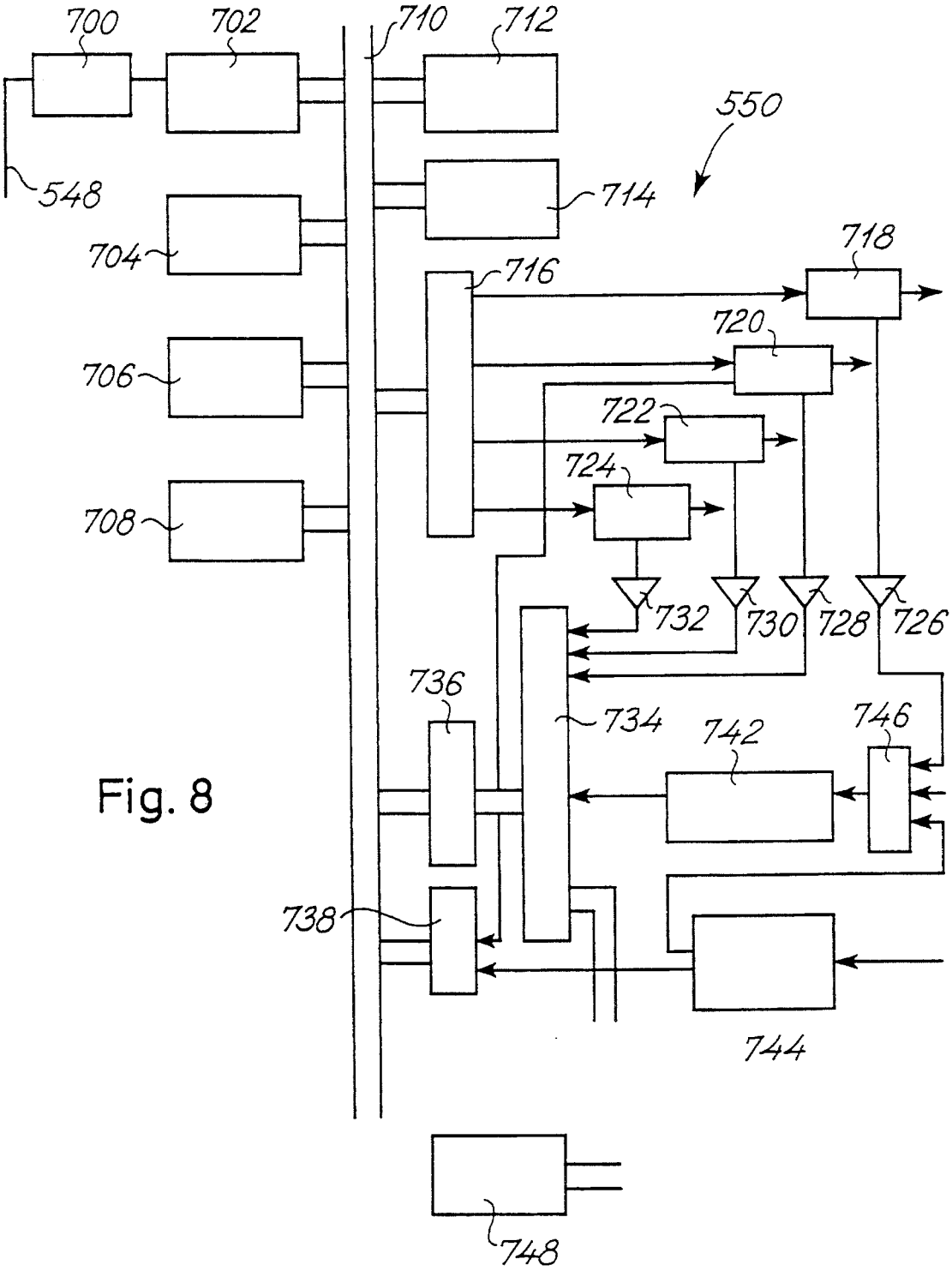

In FIG. 8, a block diagrammatical view of the first scanner controller 550 is shown. It is to be realised that the second and third scanner controllers 552 and 554 also shown in FIG. 4 are of a structure identical to the structure of the first scanner controller 550 disclosed in greater detail in FIG. 8. Thus, the first scanner controller 550 includes a BIT BUS interface 700 for interfacing with the control communication link 548 from the PC 540, the BIT BUS interface 700 interfacing the external BIT BUS or control communication line 548 with a CPU 702 of the controller 550. The internal CPU 702 of the scanner controller is preferably implemented by a 8044 enhanced micro controller and is connected to an internal data bus 710, to which a watchdog 704, an interrupt block 706, an ID register 708, a safety circuit 712, a RAM memory 714 (RAM: Random Access Memory), an AD converter (AD: Analog Digital) 736, an input port 738 and an output port 716 are also connected. The RAM memory 714 includes the downloaded program of the CPU 702, the program being downloaded from the PC 540 shown in FIG. 4 and also includes the data. The ID register 708 is readable by the CPU 702 and includes codes stating the status of the controller, i.e. defines operation of the controller as a first, second or third controller for controlling the various elements, block and components discussed above with reference to FIG. 4. The output port 716 is connected to four drivers 718, 720, 722 and 724 constituting an ultrasonic driver, a step-motor driver, a DC motor driver and a DC driver, respectively. The outputs of the drivers 718, 720, 722 and 724 are connected to inputs of gates 726, 728, 730 and 732, respectively, the gates 726–732 being connected to inputs of a multiplexer 734 which also receives input signals from a filter block 744, and a filter and amplifier block 742 the block 742 receives a multiplexed signal from a multiplexer 746, which further receives input signals from the gate 726, the filter block 744 and from an external source. The multiplexer 734 is connected to the bus 710 through the above mentioned AD converter 736. The scanner controller 550 also includes an internal power supply block 748 for supplying electrical power to the electronic circuitry of the controller.

The scanner controllers 550, 552 and 554 fulfil the following requirements:

CPU 702

For monitoring the process on the module, the processor 702 in the form a 8044 microprocessor is used. The process is controlled by means of programs downloaded from the PC 540.

The CPU 702 is connected in mode with external code and data memory, which is also physically placed in the same memory.

The ports are accessed by memory map.

CPU: 8044 Enhanced Micro Controller.

Memory 714

The scanner controllers 550, 552 and 554 are equipped with exclusively RAM. The RAM contains both the downloaded program code and data. The following two types of RAM are selectable:

2×32 k * 8

1×128 k * 8

2×32 k * 8

The RAM is a static type.

LIST OF REFERENCES

100 internal drum wall
102 light-directing assembly
**102*a*** optical section
**102*b*** motor and spinner prism section
104 laser
106 laser
108 laser
110 acousto-optical modulator
112 acousto-optical modulator
114 acousto-optical modulator
116 fiber-optical input coupler
118 fiber-optical input coupler
120 fiber-optical input coupler
122 optic fiber
124 optic fiber
126 optic fiber
128 fiber-optical joint
130 fiber-optical conductor
132 fiber-optical connector
134 fiber-optical receptacle
136 spacer component
138 flange component
140 housing part
142 screw
144 iris component
146 motor
147 electric cable
148 divergent lens
150 first optical prismatic element
152 second optical prismatic element
154 focusing lens
156 movable component
158 toothed rack
160 toothed rack
162 toothed wheel
164 toothed wheel
166 electric motor
167 electric cable
170 optical reflecting element
172 supporting component
174 aperture
176 aperture
178 element-rotating motor
179 output shaft
180 shaft housing
181 bearings
182 light-directing assembly housing
184 fixation flange of the light-directing assembly
186 encoder component
187 electric cable
188 bracket
190 screw
191 screw
192 support bracket
193 guide component
192 bearings
194 carriage
195 flange motor
196 threaded rod
197 viscous muffler
198 electric motor
199 clutch
200 bearing
204 end wall
206 end wall
208 roller bearing assembly
210 roller bearing assembly
212 bellows component
214 bellows component
220 trough-shaped frame component
222 fin
224 heat insulating plate component
240 power supply unit
242 electronic component housing
244 electronic component housing
246 electronic component housing
248 electronic component housing
250 housing component
258 exhaust hose
260 encapsulated domain
262 air-conditioning unit
264 air
266 air
268 return air tube
270 injection air tube
272 condenser
274 fan
276 filter
278 fan
280 cooling surface
282 heating element
284 humidifier
286 sensing means
288 sensing means
290 control
292 compressor
300 film cassette
302 compartment
304 compartment
306 compartment
308 partition wall
310 partition wall
312 partition wall
314 film roller
316 film roller
318 film roller
320 end wall component
322 end wall component
324 lid component

326 lid component
328 lid component
330 roller
332 roller
334 roller
336 roller
338 roller
340 roller
342 spring
344 spring
346 spring
350 roller driven by pulley 368
352 electric motor
354 drive pulley
356 crank drive
358 pulley
360 belt
362 electric motor
364 output shaft
366 drive pulley
368 pulley
370 belt
372 roller
374 roller
376 space
382 locking tool
384 locking tool
386 locking tool
388 locking tool
390 stationary cutting knife
392 cutting wheel
394 support structure
396 threaded shaft
398 electric motor
400 transport belt
402 drive roller
404 output shaft
406 pulley
408 drive pulley
410 electric motor
412 belt
420 transport belt
422 roller
424 roller
430 arrow
432 film receiving cassette
500 dotted line block including electronic circuitry
502 VSB TAXI module (VME SUBSYSTEM BUS Transparent Asynchronous Xmitter Receiver)
503 transmission to VSB TAXI module
504 RIP Module Raster Image Processor Module
505 input/output block
506 transmitter
507 transmission arrow
508 receiver
509 dotted line block
510 receiver
511 transmission arrow
512 transmitter
513 BIT BUS TAXI module
514 CpU of 513 BIT BUS TAXI module
515 FIFO module (First In First Out) module
516 Output port
518 CPU or Central Processing Unit
520 PLL circuit (Phase Locked Loop circuit)
522 Motor Control Module
524 CPU of 522 Motor control module
526 Laser output terminal
528, 530, 532, 534 and 536: terminals connected to an end stop detector, a rotatably shaft controller, a spinner encoder, a step motor controller and a spindle feedback detector
540 PC or terminal
542 screen of PC 540
544 CPU of PC 540
546 keyboard of PC 540
548 control communication line from PC to laser image setter
550 first scanner control
552 second scanner control
554 third scanner control
556 locking tools
558 laser or lasers
560 temperature detectors
562 film loading detector
564 loader
566 cutting motor
568 cutter detector
580 VSB interface
582 FIFO 4k×32
584 retransmit controller
586 parity generator
588 transmission controller
590 command logic controller
592 command logic controller
594 FIFO 256×8
596 receiver controller
598 TAXI transmitter
600 parity check block
602 TAXI receiver
604 test loop back block
606 Loop back selector
608 TAXI receiver
612 TAXI transmitter
614 parity check block
616 port
618 buffer
620 parity generator
622 port
624 FIFO 16 k 8 Bit
625 FIFO READ/WRITE CONTROLLER
626 port
628 BIT BUS block including a CPU and a watchdog
630 program data
632 program control
634 program control
636 program control
638 program
642 driver
644 Pixel data
646 BIT BUS CPU 1
648 WRITE control
650 WRITE control
652 WRITE control
654 port
656 port
658 port
660 port
662 FIFO 16 k×6
664 port
666 WRITE control block
668 WRITE control block
670 READ control block
672 READ control block

674 SHIFT register
676 port
678 synchronising generator
680 port
682 Pixel control
684 linear movement control
680 port
688 data selector
690 laser controller
692 rotatably shaft controller
694 BIT BUS CPU 2
696 step motor controller
698 data selector
700 BIT BUS interface
702 CPU
704 watchdog
706 interrupt block
708 ID register
710 databus
712 safety circuit
714 RAM memory
716 output port
718 ultrasound driver
720 step motor driver
722 DC motor driver
724 DC driver
726 gate
728 gate
730 gate
732 gate
734 multiplexer
736 AD counter
738 input port
742 filters and amplifiers
744 filters
746 multiplexer
748 power supply

We claim:

1. An apparatus for exposing a film or plate comprising a light-sensitive material to a light beam, comprising:

an apparatus housing having an elongated cavity defining an inner support for supporting the film or plate in such a manner that the supported film or plate constitutes at least a part of a substantially circularly-cylindrical surface defining a central axis, laser means for generating the light beam, a light-directing assembly comprising a light-directing assembly housing, a laser light-emitter emitting laser light generated by the laser means, a rotatable optically reflecting element and an element-rotating motor, the laser light-emitter being constituted by the second end of an optical fibre means having a first light-receiving end and a second light-emitting end, the first light-receiving end being arranged in juxtaposition to the laser means for receiving the light beam therefrom, and the second light-emitting end being arranged in and supported by the light-directing assembly housing and being in juxtaposition to the rotatable optically reflecting element at a substantially fixed distance therefrom for emitting the light beam to the rotatable optically reflecting element, the rotatable optically reflecting element being arranged relative to the second light-emitting end of the optical fiber so as to direct the light beam emitted to the optically reflecting element to the light-sensitive film or plate, the element-rotating motor being supported by the light-directing assembly housing and having a rotatable output shaft, the optically reflecting element being connected to the output shaft so as to be rotatably driven thereby, and the light-directing assembly housing being supported by the apparatus housing and being movable relative thereto along the central axis, motion means for moving the light-directing assembly relative to the apparatus housing along the central axis, and central control means for controlling the laser means for switching the laser beam on and off, for controlling the operation of the element-rotating motor, and for controlling the operation of the motion means so as to expose a predetermined area of the photographic film by switching on the laser beam while the light-directing assembly is in a predetermined position relative to the apparatus housing and while the rotatable optically reflecting element is in a predetermined rotational position.

2. An apparatus according to claim 1, in which the inner support comprises a support surface for supporting the film or plate substantially in conformity with the support surface, the support surface constituting at least a part of a substantially circular-cylindrical surface defining the central axis.

3. An apparatus according to claim 1, in which the optical fiber means is a single-mode fiber means.

4. An apparatus according to claim 1, in which the output shaft of the element-rotating motor is rotatably journaled in the-light-directing assembly by means of air guidings.

5. An apparatus according to claim 1, in which the a laser means is arranged in the light-directing assembly housing.

6. An apparatus according to claim 1, in which the laser means comprises a laser selected from argon ion lasers, HeNe lasers, HeCd lasers, frequency-doubled Nd:YAG lasers, and diode lasers, including frequency-doubled diode lasers.

7. An apparatus according to claim 1, in which the laser means comprise an infrared laser.

8. An apparatus according to claim 1, in which the rotatable optically reflecting element is constituted by a rotatable optical prismatic element rigidly connected to the output shaft of the element-rotating motor and is rotatable in a rotational motion defining a rotational axis coinciding with the central axis, and in which the light beam emitted from the laser light-emitter is directed to the rotatable optical prismatic element along the central axis.

9. An apparatus according to claim 1, further comprising an iris means and a collimator means interposed between the laser light-emitter and the rotatable optical prismatic element and is supported by the light-directing assembly housing.

10. An apparatus according to claim 1, further comprising encoder means connected to the central control means and generating an encoder signal representing the rotational position of the rotatable optically reflecting element relative to the central axis.

11. An apparatus according to claim 10, in which the control means controls the motion means in accordance with the encoder signal.

12. An apparatus according to claim 10, in which the encoder means comprises an encoder disc fixed directly on the shaft to which the rotatable optically reflecting element is fixed.

13. An apparatus according to claim 1, in which the element-rotating motor and the motion means are operated continuously.

14. An apparatus according to claim 1, in which the light-directing assembly housing is supported by the apparatus housing through a carriage which is supported by the apparatus housing through guiding means which permit the carriage to move parallel to the central axis.

15. An apparatus according to claim 14, in which the guiding means comprise two bearing elements extending longitudinally parallel to the central axis, one of the bearing elements supporting the carriage in a two-plane manner, the other bearing element supporting the carriage in a one-plane manner, the two bearing elements together thus supporting the carriage in a statically determined manner.

16. An apparatus according to claim 15 in which the carriage is pulled downwards towards the apparatus housing by magnetic attraction forces generated by magnets arranged longitudinally in the carriage or in the housing, so as to assist the gravity force in securing the carriage to the apparatus housing and preload the carriage against the apparatus housing to secure permanent contact between the carriage and the apparatus housing through the bearing elements, maintaining the support of the carriage in a statically determined manner.

17. An apparatus according to claim 16, in which the magnets are arranged longitudinally in the carriage in such a manner that the concentration of magnetic forces is higher along a part of the carriage where the light-directing assembly is arranged so as to compensate for or counteract an added moment along that part.

18. An apparatus according to claim 15, wherein the bearing elements are selected from ball or roller bearing assemblies, sliding guides, and aerostatic bearing assemblies.

19. An apparatus according to claim 14, wherein the motion means comprise a threaded shaft and a drive motor connected to the threaded shaft for causing the threaded shaft to rotate, and wherein the carriage comprises a part having an internal thread meshing with the threaded shaft.

20. An apparatus according to claim 1 in which a domain thereof comprising the apparatus housing and the light-directing assembly is encapsulated, preferably with a thermally insulating material, and the encapsulated domain is air-conditioned by a controllable air-conditioning system to permit control of temperature and humidity conditions within the domain.

21. An apparatus according to claim 20, in which the laser means is arranged outside the air-conditioned domain, and the laser light is directed into the light-directing assembly by means of the optical fiber means.

22. An apparatus according to claim 1, in which the laser means comprises three lasers, namely a red laser, a green laser and a blue laser, and the optical fiber means comprises three separate optical fibers connected to the red laser, the green laser and the blue laser, respectively.

23. An apparatus according to claim 22, in which the red laser is constituted by a red HeNe laser generating laser light of wavelength about 633 nm, or a red diode laser generating laser light of wavelength about 635 nm or of about 670 nm; the green laser is constituted by a green HeNe laser generating laser light of wavelength about 543.5 nm, a green frequency-doubled Nd:YAG laser generating laser light of wavelength about 532 nm, or a green argon ion laser generating laser light of wavelength about 514.5 nm, and the blue laser is constituted by a blue argon ion laser generating laser light of wavelength about 488 nm, a blue HeCd laser generating laser light of wavelength about 441 nm, or a frequency-doubled diode laser generating laser light of wavelength about 420 nm.

24. An apparatus according to claim 1, in which the laser means comprise acousto-optical modulator means for switching the laser beam on and off.

* * * * *